US010240377B2

(12) United States Patent
Arai

(10) Patent No.: US 10,240,377 B2
(45) Date of Patent: Mar. 26, 2019

(54) HINGE DEVICE AND HINGE DEVICE BASE

(71) Applicant: SUGATSUNE KOGYO CO., LTD., Chiyoda-ku, Tokyo (JP)

(72) Inventor: Masato Arai, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 15/036,047

(22) PCT Filed: Nov. 5, 2014

(86) PCT No.: PCT/JP2014/079300
§ 371 (c)(1),
(2) Date: May 11, 2016

(87) PCT Pub. No.: WO2015/068714
PCT Pub. Date: May 14, 2015

(65) Prior Publication Data

US 2016/0281403 A1 Sep. 29, 2016

(30) Foreign Application Priority Data

Nov. 11, 2013 (JP) ..... 2013-232729

(51) Int. Cl.
*E05D 7/04* (2006.01)
*E05D 7/12* (2006.01)

(52) U.S. Cl.
CPC ..... *E05D 7/04* (2013.01); *E05D 7/0407* (2013.01); *E05D 7/0415* (2013.01); *E05D 7/125* (2013.01);

(Continued)

(58) Field of Classification Search
CPC ..... E05D 7/04; E05D 7/0407; E05D 7/0415; E05D 7/0423; E05D 7/0009; E05D 7/0054; E05D 2007/0469; E05D 2007/0492
See application file for complete search history.

(56) References Cited

U.S. PATENT DOCUMENTS 3,952,366 A * 4/1976 Rock ..... E05D 7/04 16/235
3,965,530 A * 6/1976 Rock ..... E05D 7/0407 16/237

(Continued)

FOREIGN PATENT DOCUMENTS

AT 3531 U1 4/2000
EP 2 634 334 A1 9/2013

(Continued)

OTHER PUBLICATIONS

International Search Authority/JPO, International Search Report dated Dec. 16, 2014 in International Patent Application No. PCT/JP2014/079300 (with English translation), 5 pages.

(Continued)

*Primary Examiner* — Jeffrey O'Brien
(74) *Attorney, Agent, or Firm* — Masuvalley & Partners

(57) ABSTRACT

Provided is a hinge device easy to machine and manufacture. A shaft guiding recessed section and a fitting recessed section are formed on a first face of substrate of a hinge device base. As a first position adjusting mechanism, a substrate side guiding section is provided on a bottom face of the shaft guiding recessed section, and a first adjusting shaft is provided between the substrate and a first movable member. A first shaft-side guiding section of the first adjusting shaft engages with the substrate side guiding section by being accommodated in the shaft guiding recessed section, and a first shaft part of the first adjusting shaft rotatably (Continued)

engages with the first movable member. A fitting section is provided in the first movable member, and the fitting section is inserted into the fitting recessed section so as to be able to slide in a first direction.

9 Claims, 14 Drawing Sheets

(52) U.S. Cl.
CPC ..... *E05D 2007/0469* (2013.01); *E05D 2007/0484* (2013.01); *E05D 2007/0492* (2013.01); *E05Y 2201/638* (2013.01)

(56) References Cited

U.S. PATENT DOCUMENTS 4,674,148 A * 6/1987 Salice ..... E05D 7/125 16/258
4,882,808 A * 11/1989 Rock ..... E05D 7/0407 16/240
5,022,116 A * 6/1991 Salice ..... E05D 7/0407 16/258
5,920,958 A * 7/1999 Domenig ..... E05D 7/0423 16/237
5,964,010 A * 10/1999 Huber ..... E05D 7/0407 16/237
6,032,333 A * 3/2000 Brustle ..... E05D 7/0407 16/240
6,233,783 B1 * 5/2001 Dubach ..... E05D 7/0407 16/236
6,622,343 B2 * 9/2003 Rupprechter ..... E05D 5/08 16/242
6,880,205 B2 * 4/2005 Rupprechter ..... E05D 7/0415 16/235
6,918,158 B2 * 7/2005 Isele ..... E05D 7/0415 16/235
8,707,517 B2 * 4/2014 Hofer ..... E05D 5/065 16/240
8,904,599 B2 * 12/2014 Migli ..... E05D 5/0276 16/258
9,169,681 B2 * 10/2015 Cooper ..... E05D 3/14
9,341,010 B2 * 5/2016 Pyo ..... E05D 7/0407
2010/0281652 A1 * 11/2010 Oshima ..... E05D 7/0407 16/236

FOREIGN PATENT DOCUMENTS

JP 3198417 B2 8/2001
JP 3138277 U 12/2007
JP 2010-261279 A 11/2010

OTHER PUBLICATIONS

EPO, Supplementary European Search Report dated Aug. 11, 2017 in corresponding EP Application No. 14859679.4, 8 pages.

* cited by examiner

HINGE DEVICE AND HINGE DEVICE BASE

CROSS-REFERENCE TO RELATED APPLICATIONS

This application is the national phase entry under 35 U.S.C. § 371 of International Application No. PCT/JP2014/079300, filed on Nov. 5, 2014, which claims priority under 35 U.S.C. § 119 to Japanese Patent Application No. 2013-232729, filed on Nov. 11, 2013, the contents of which are hereby incorporated by reference in their entirety for all purposes.

TECHNICAL FIELD

The present invention pertains to a hinge device for rotatably attaching a door to a frame of furniture or the like for example, and to a base for the hinge device, and more specifically pertains to a hinge device having an adjustment mechanism for adjusting a position of a door with respect to a frame and to a base thereof.

BACKGROUND ART

Ordinarily, this type of hinge device has a base (hinge device base), a body part removably connected to this base, and an attachment member rotatably connected to a tip end part of the body part (for example, see patent document 1: Japanese Patent No. 3198417). The base is attached to a frame, and the attachment member is attached to a door. In this manner, the door is rotatably supported to the frame via the hinge device.

Furthermore, the hinge device of patent document 1 is provided with a position adjusting mechanism for adjusting the position of the door with respect to the frame in three directions by adjusting the position of the body part with respect to the base in three directions, namely the front and back direction, the right and left direction, and the vertical direction. More specifically, the base described by patent document 1 includes a base plate and a middle member, and the body part is connected to the middle member so as to be capable of movement in two directions, namely the front and back direction and the left and right direction. A mechanism for adjusting the position in the front and back direction and configured from a spiral cam and rack, and a mechanism for adjusting the position left and right and configured from a screw are provided between the middle member and the body part. Moreover, the base plate is configured from two plate members. These two plate members are connected so as to be capable of moving up and down (height direction), and a mechanism for adjusting the position vertically and configured from a spiral cam and rack separate from the abovementioned spiral cam and rack is provided between the two plate members themselves.

A recess is formed in the front side surface of one of the plate members, and the rack of the abovementioned vertical position adjusting mechanism is formed at the bottom face of this recess. The spiral cam of the vertical position adjusting mechanism is arranged in this recess, and engages with the rack, and a portion of the spiral cam protrudes more than an edge of one side of the abovementioned one plate member. A cylindrical retaining body is provided at the front side surface of the spiral cam so as to project, and a cross-shaped groove in which a Phillips-head screwdriver can be inserted is formed in the front side surface of the cylindrical retaining body. Moreover, a circular opening in which the cylindrical retaining body is rotatably inserted is formed in the other plate member. Furthermore, projection bodies having an L-shape profile are integrally formed respectively in both edges of the other plate member, and these projection bodies slidably catch on both edges of the one plate member. Accordingly, the two plate members fit together by mutually sliding, but at this time, the other plate member catches on the protrusion portion of the spiral cam and cylindrical retaining body. Therefore, the hinge device of patent document 1 is not easy to machine and manufacture.

SUMMARY OF THE INVENTION

In light of the abovementioned circumstances, an object of the present invention is to simplify the machining and manufacturing of the hinge device.

In order to resolve the abovementioned problem, the present invention pertains to a hinge device including a base, a body part, and an attachment member rotatably connected to the body part, wherein the base includes a substrate having a first face, a first movable member provided on the first face so as to be movable in a first direction along the first face with respect to the substrate, and a first position adjusting mechanism for adjusting a position of the first movable member in the first direction with respect to the substrate, and the first movable member and the body part are removably connected either indirectly or directly. The present invention also pertains to a hinge device base including a substrate having a first face, a first movable member provided on the first face so as to be capable of moving in a first direction along the first face with respect to the substrate, and a first position adjusting mechanism for adjusting a position of the first movable member in the first direction with respect to the substrate, and the first movable member is removably connected either indirectly or directly to a body part, which is rotatably connected to an attachment member.

With the abovementioned hinge device or hinge device base of the present invention, a shaft guiding recessed section and a fitting recessed section are formed on the first face of the substrate; as the first position adjusting mechanism, a substrate side guiding section is provided on the shaft guiding recessed section, and a first adjusting shaft is provided between the substrate and the first movable member, and the first adjusting shaft has, in an integrated form, a first shaft part which rotatably engages to the first movable member around a first rotation axis line orthogonal to the first face and is inserted into the shaft guiding recessed section so as to be guided in the first direction, and a first shaft-side guiding section which engages with the substrate side guiding section; and a fitting section is provided in the first movable member, and the fitting section is inserted into the fitting recessed section so as to be capable of sliding in the first direction.

In this manner, machining and manufacturing of the substrate can be simplified, and manufacturing of the hinge device can be simplified.

The shaft guiding recessed section and the fitting recessed section are preferably joined such that the mutual bottom faces thereof become flush.

Through this, machining and manufacturing of the substrate can be further simplified, and manufacturing of the hinge device can be further simplified.

Preferably, the fitting recessed section is provided as a pair at both sides of the shaft guiding recessed section in the first direction, the fitting section is provided as a pair at both sides of the first movable member in the first direction, and each fitting section is inserted into the corresponding fitting recessed section so as to be capable of sliding in the first direction. In this manner, the first movable member can be more stably installed on the substrate, and the first movable member can be more stably guided in the first direction.

Preferably, the first movable member runs along the first face and extends in a second direction orthogonal to the first direction, and a locking protrusion is formed at one end of the first movable member in the second direction, and the locking protrusion catches on an edge of the substrate in the second direction so as to be capable of sliding in the first direction; and a connection projection is further provided at the substrate, and the other end of the first movable member in the second direction is connected by a connection pin, extending in the first direction, to the connection projection so as to be capable of moving in the first direction.

Through this, assembly of the hinge device base can be simplified.

Preferably, the base further includes a second movable member running along the first face with respect to the first movable member and capable of moving in a second direction orthogonal to the first direction, and a second position adjusting mechanism for adjusting a position of the second movable member in the second direction with respect to the first movable member, and the second movable member has a connection part removably connecting to the body part, sandwiches the first movable member, and is provided at a side opposite the substrate; and as the second position adjusting mechanism, a first movable side guiding section is provided at the first movable member, and a second adjusting shaft is provided between the first movable member and the second movable member, and the second adjusting shaft has, in an integrated form, a second shaft part rotatably engaged to the second movable member around a second rotation axis line parallel to the first rotation axis line, and a second shaft-side guiding section which engages with the first movable side guiding section.

In this manner, the position of the body part can be adjusted in the second direction as well. In addition, assembly of the hinge device base can also be simplified.

According to the present invention, machining and manufacturing or a hinge device base can be simplified.

BRIEF DESCRIPTION OF THE DRAWINGS

FIG. 13A is a perspective view as viewed from the front and forward direction, and FIG. 13B is a perspective view as viewed from the back and forward direction.

FIG. 14A is a perspective view as viewed from the front and forward direction, and FIG. 14B is a perspective view as viewed from the back and forward direction.

DETAILED DESCRIPTION OF THE INVENTION

Embodiments of the present invention are described below. FIGS. 1 to 11 show a first embodiment of the present invention.

Figure 1:
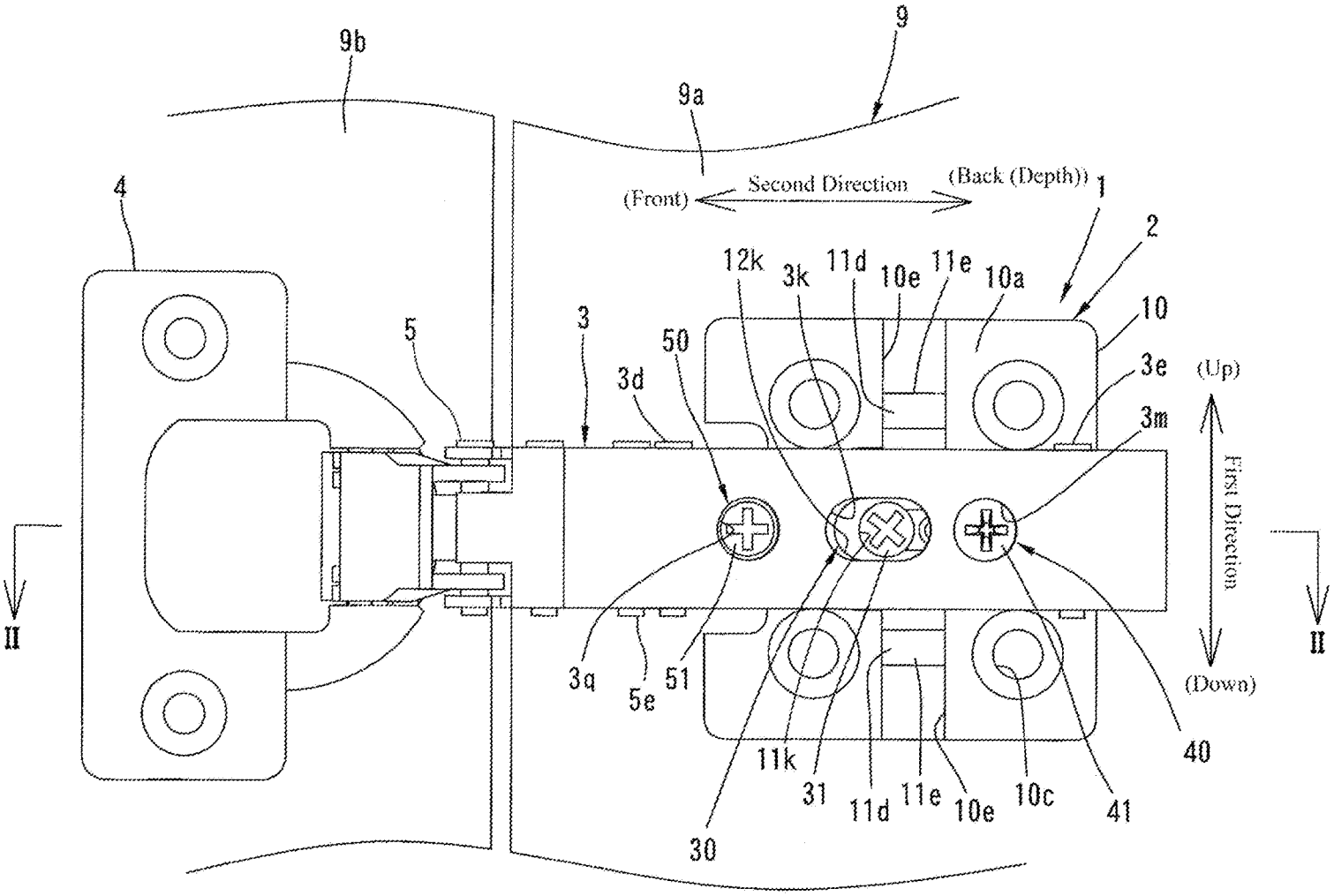
FIG. 1 is an elevation view as viewed from the front with a hinge device according to a first embodiment of the present invention attached to a frame, and a door of the frame opened.
Figure 2:
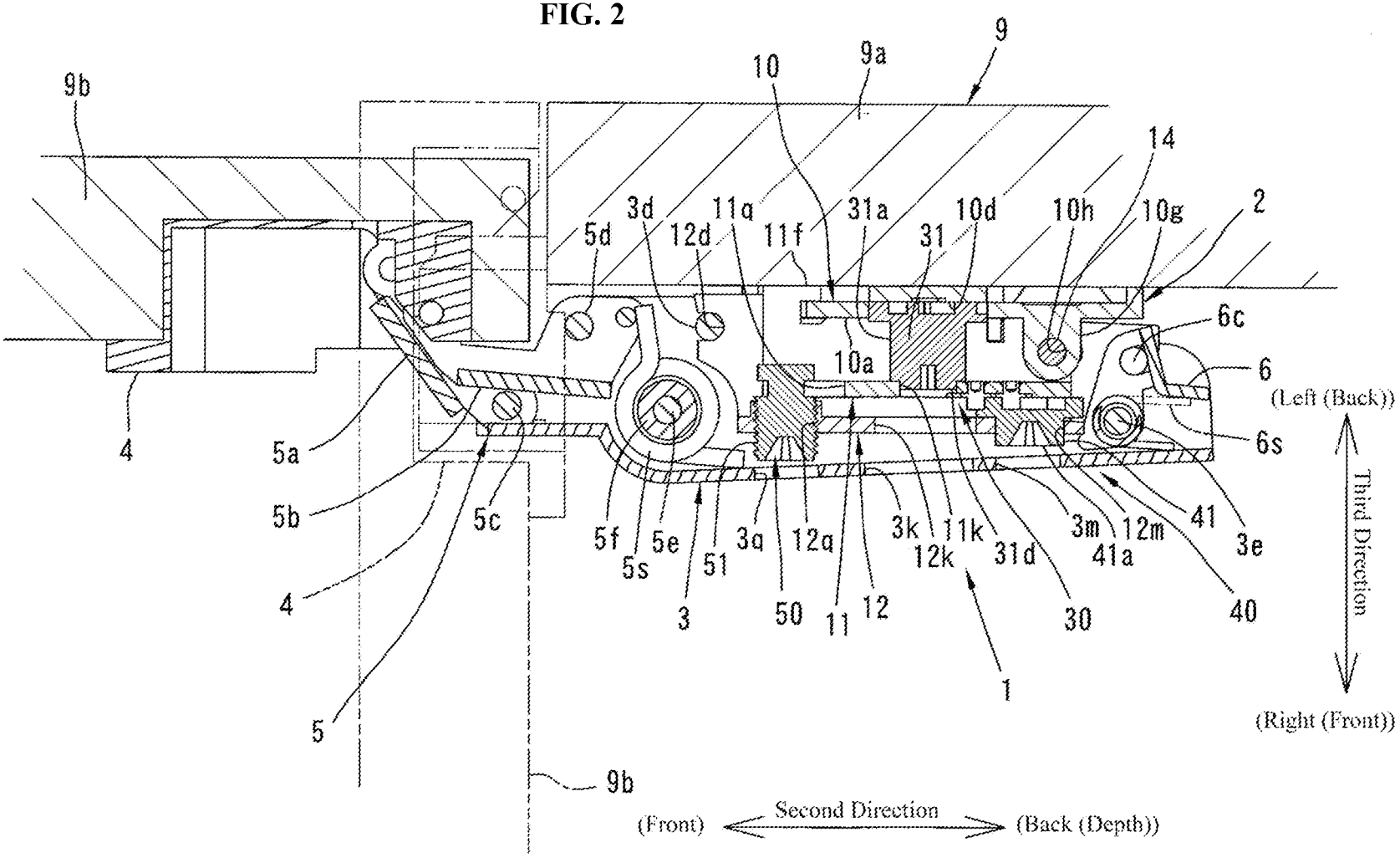
FIG. 2 is a cross-sectional plan view of the hinge device along the line II-II of FIG. 1.

As shown by FIG. 1 and FIG. 2, a door 9*b* is rotatably connected around a vertical axis via a hinge device 1 to a vertical side wall 9*a* (frame body) of a frame 9 of furniture or the like, for example. The hinge device 1 straddles from the side wall 9*a* to the door 9*b* with a front part oriented toward the right direction, a back part oriented toward the left direction, a tip end part oriented toward the front direction, a back end part oriented toward the interior direction, and the width direction oriented in the vertical direction (first direction). Furthermore, the hinge device 1 is provided with a function to adjust the position of the door 9*b* with respect to the side wall 9*a* in three directions, namely, the vertical, front and back (second direction orthogonal to the first direction), and left and right direction (third direction orthogonal to both the first direction and the second direction).

Figure 3:
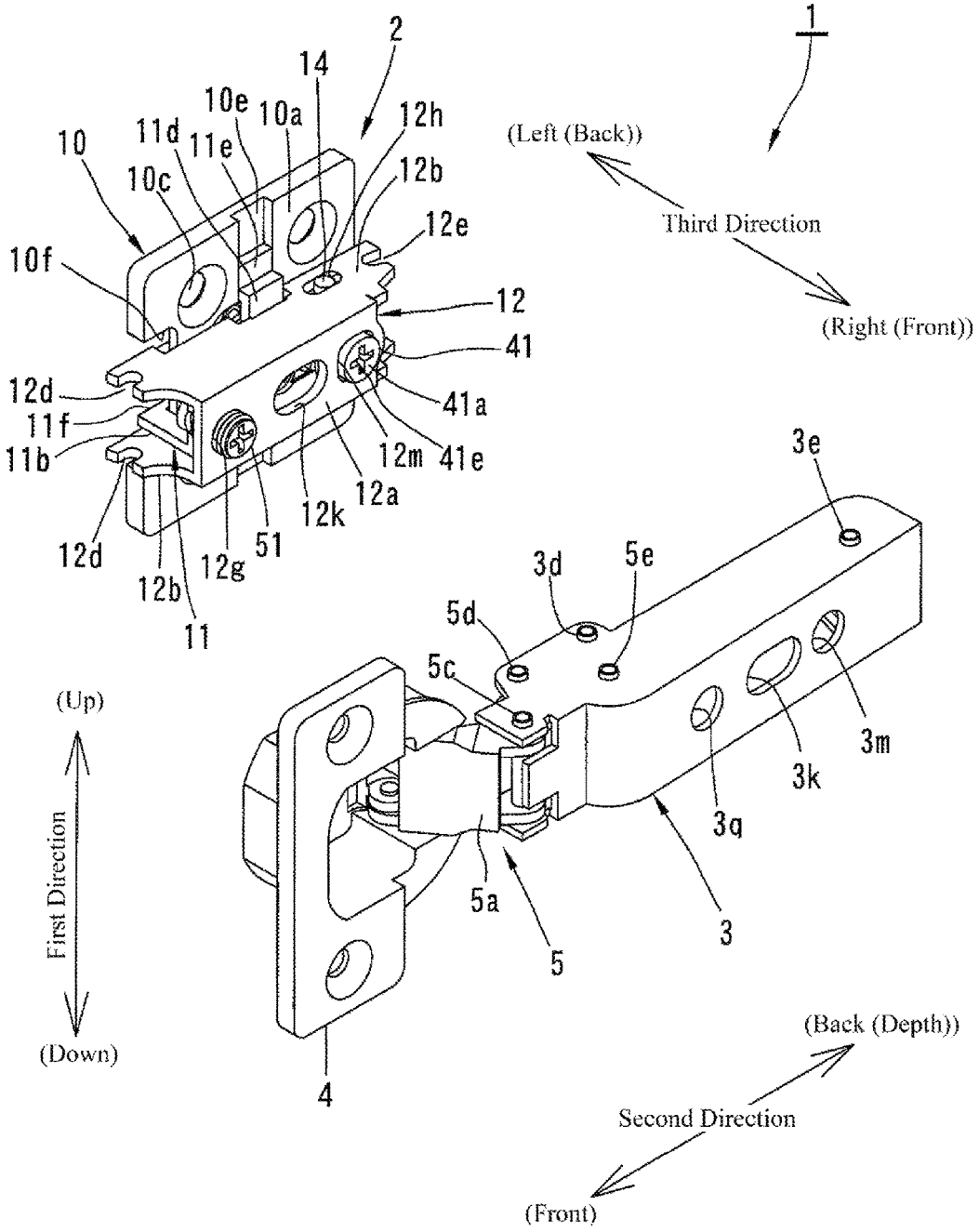
FIG. 3 is a perspective view showing the body party of the hinge device and the hinge device base separated.
Figure 4:
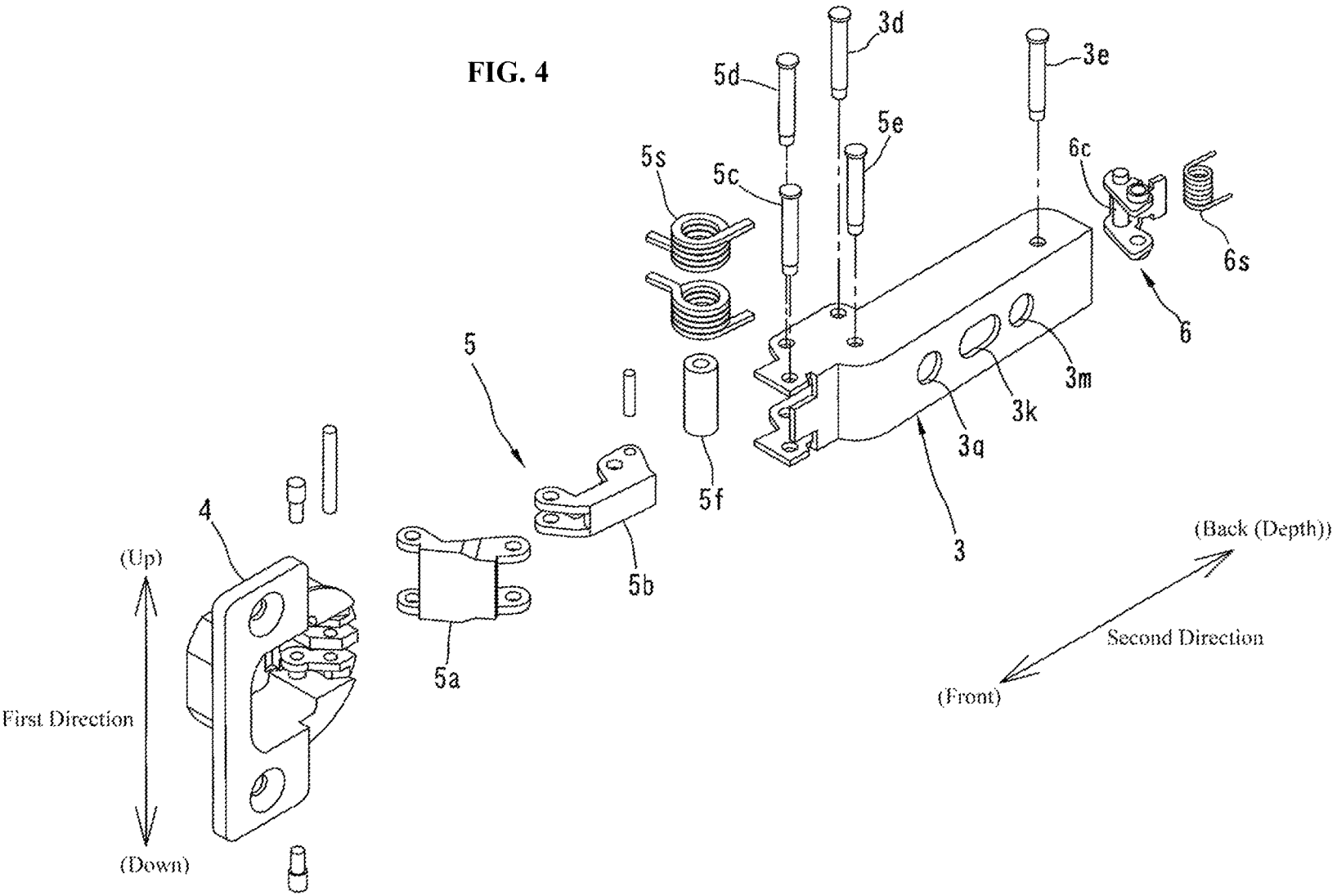
FIG. 4 is an exploded perspective view of the body part.

More specifically, as shown in FIG. 2 and FIG. 3, the hinge device 1 is provided with a base 2 (hinge device base), and a body part 3. The base 2 is secured to the side wall 9*a*. The body part 3 removably covers the front of the base 2 (bottom in FIG. 2 and top in FIG. 3). The body part 3 has a roughly U-shaped profile with an internal space opening toward the back (top in FIG. 2 and bottom in FIG. 3), and extends in the front and back directions (second direction orthogonal to the first direction). An attachment member 4 is rotatably connected via a connection mechanism 5 to a front end part of the body part 3 (left in FIG. 2). The door 9*b* is fixed to this attachment member 4. As shown in FIG. 2 and FIG. 4, the connection mechanism 5 includes two links 5*a*, 5*b*. Base end parts of these links 5*a*, 5*b* are respectively connected to the front end part of the body part 3 via respective connection pins 5*c*, 5*d*, tip end parts of the links 5*a*, 5*b* are respectively connected to the attachment member 4, and in this manner, a four-node link mechanism is configured. Through this four-node link mechanism, when in the opened state (solid line in FIG. 2), a front end face of the side wall 9*a* and an end face of the door 9*b* face each other, and in the closed state (long and short dashed line of FIG. 2), an end part of an inside surface of the door 9*b* covers the front end face of the side wall 9*a*, and the door

9*b* can be opened and closed. Furthermore, a torsion coil spring 5S is provided at the front end part of the body part 3 via a support pin 5*e* and a support cylinder 5*f*. Through this torsion coil spring 5S, when in an opened state, the door 9*b* is biased in the opening direction (clockwise direction in FIG. 2), and when in the semi-opened to closed state, the door 9*b* is biased in the closing direction (counterclockwise direction in FIG. 2).

The hinge device base 2 is configured as follows.

Figure 5:
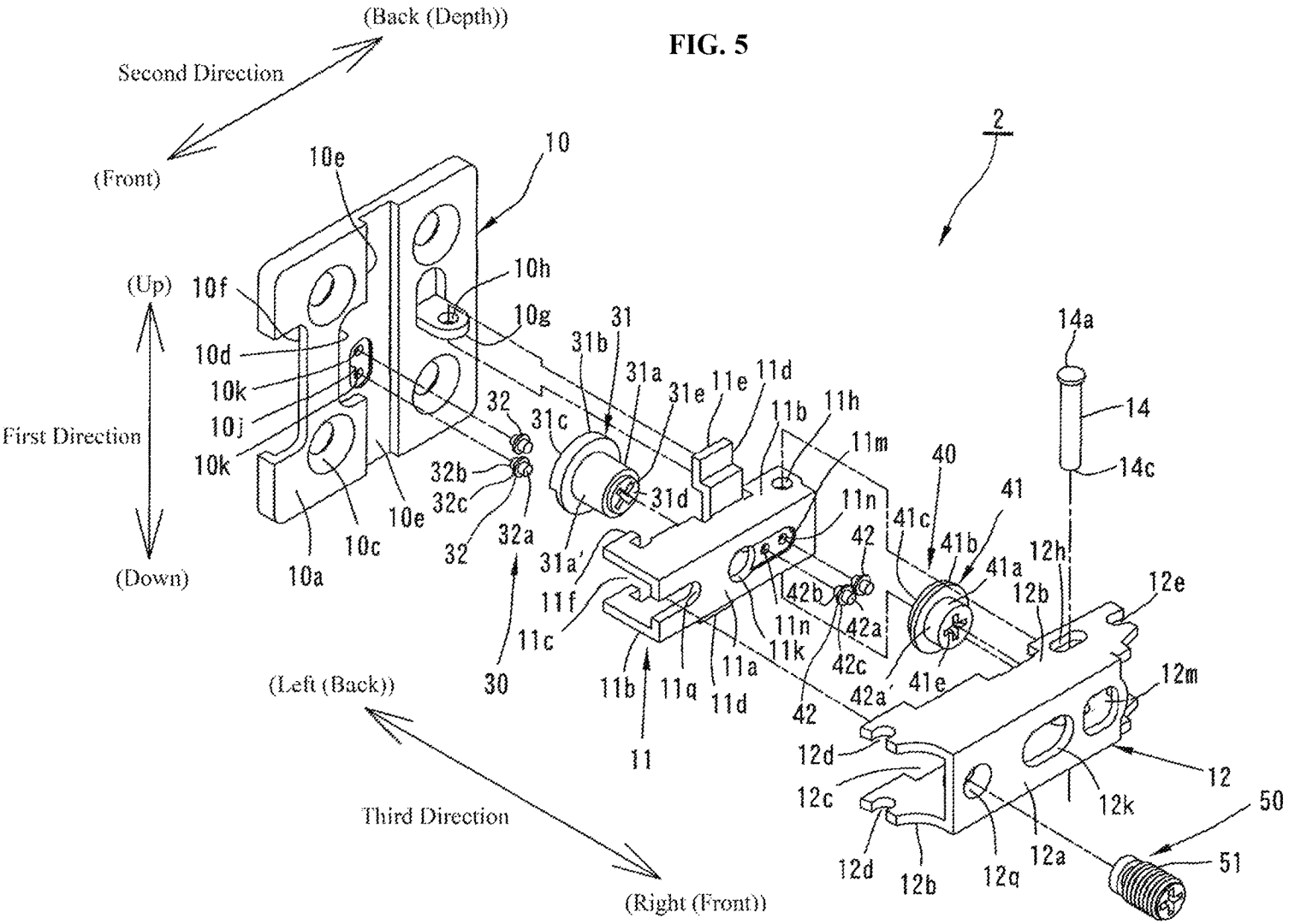
FIG. 5 is an exploded perspective view of the hinge device base.
Figure 6:
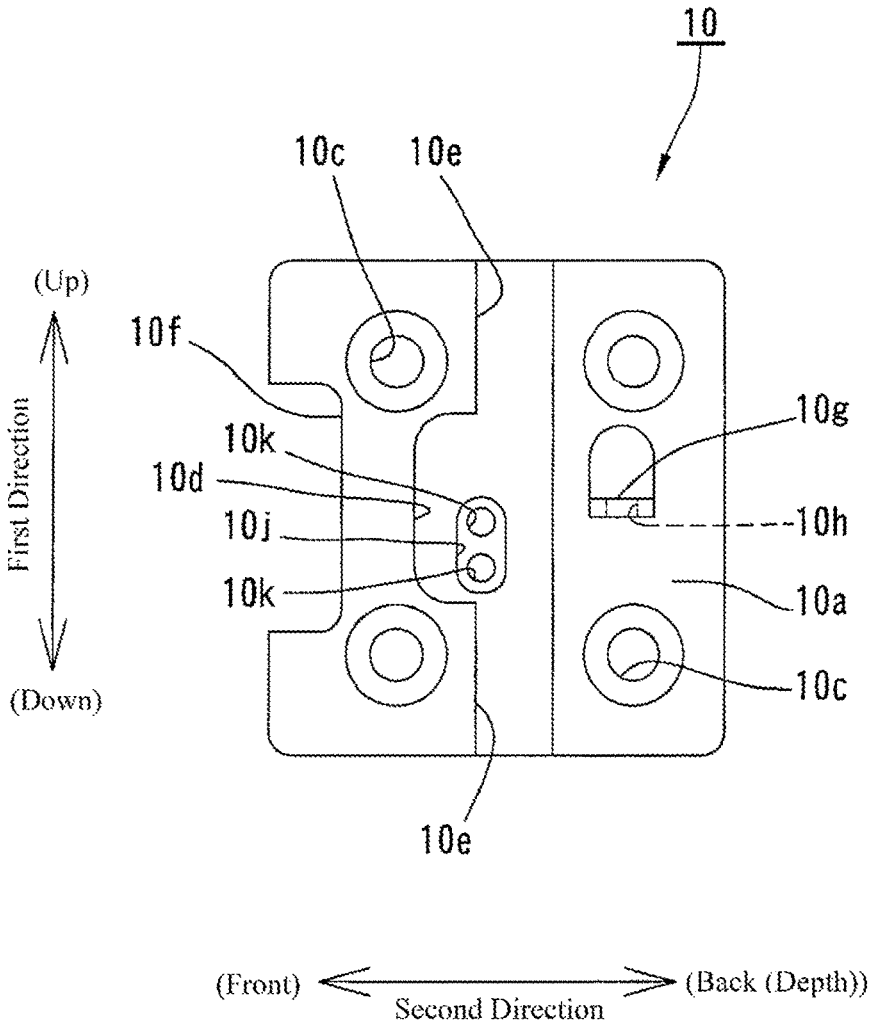
FIG. 6 is an elevation view showing a substrate of the hinge device base viewed from the front.
Figure 7A:
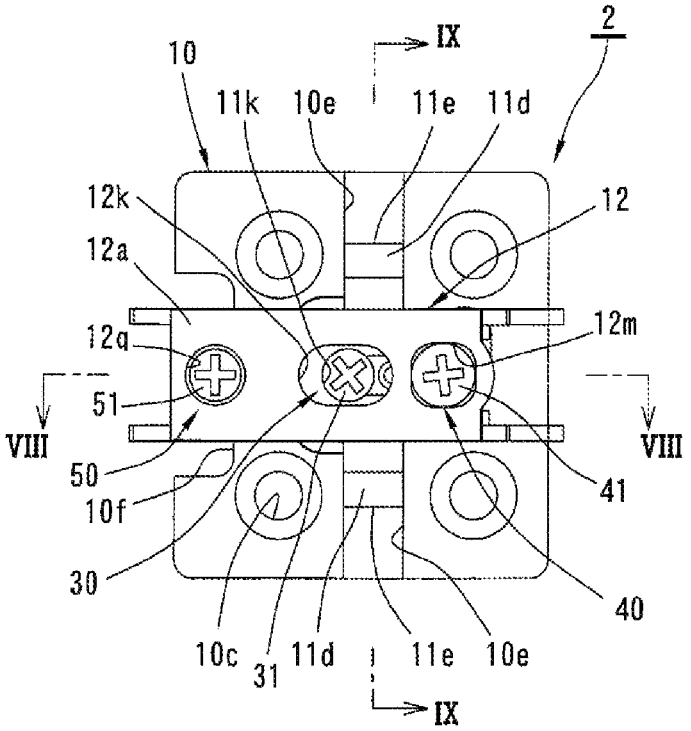
FIG. 7A is an elevation view showing the hinge device base viewed from the front.
Figure 7B:
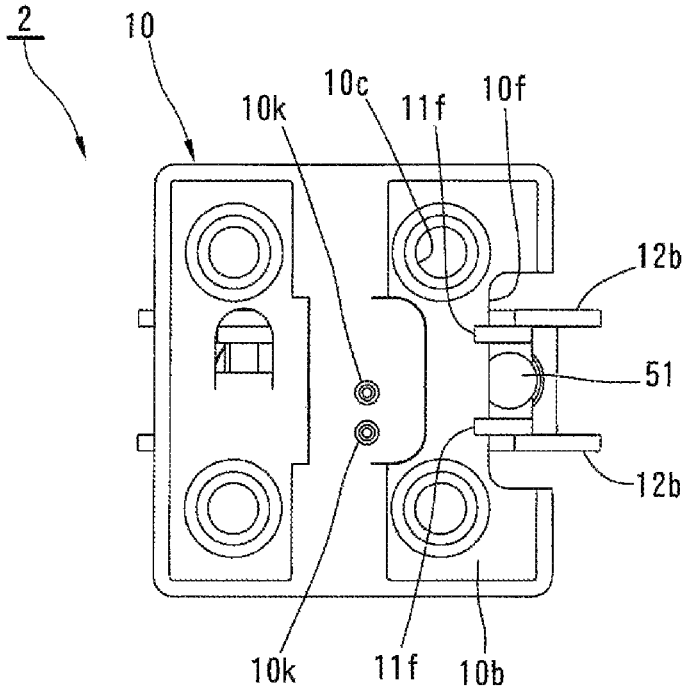
FIG. 7B is a rear view of the hinge device base as seen from the back side.

As shown in FIG. 5, the base 2 has a substrate 10, a first movable member 11, and a second movable member 12. As shown in FIG. 6 and FIG. 7B, the substrate 10 has a roughly quadrilateral plate shape and has a front side surface 10*a* facing the front (front direction of the paper in FIG. 6), and a rear surface 10*b* facing the back (front direction of the paper in FIG. 7B). As shown by FIG. 1 and FIG. 2, this substrate 10 is screwed to the side wall 9*a* through screw insertion holes 10*c* at four corners. The front side surface 10*a* of the substrate 10 configures the "first face" of the claims by being oriented along the first direction and the second direction and being orthogonal to the third direction. The rear surface 10*b* is fastened to the side wall 9*a*.

Figure 8:
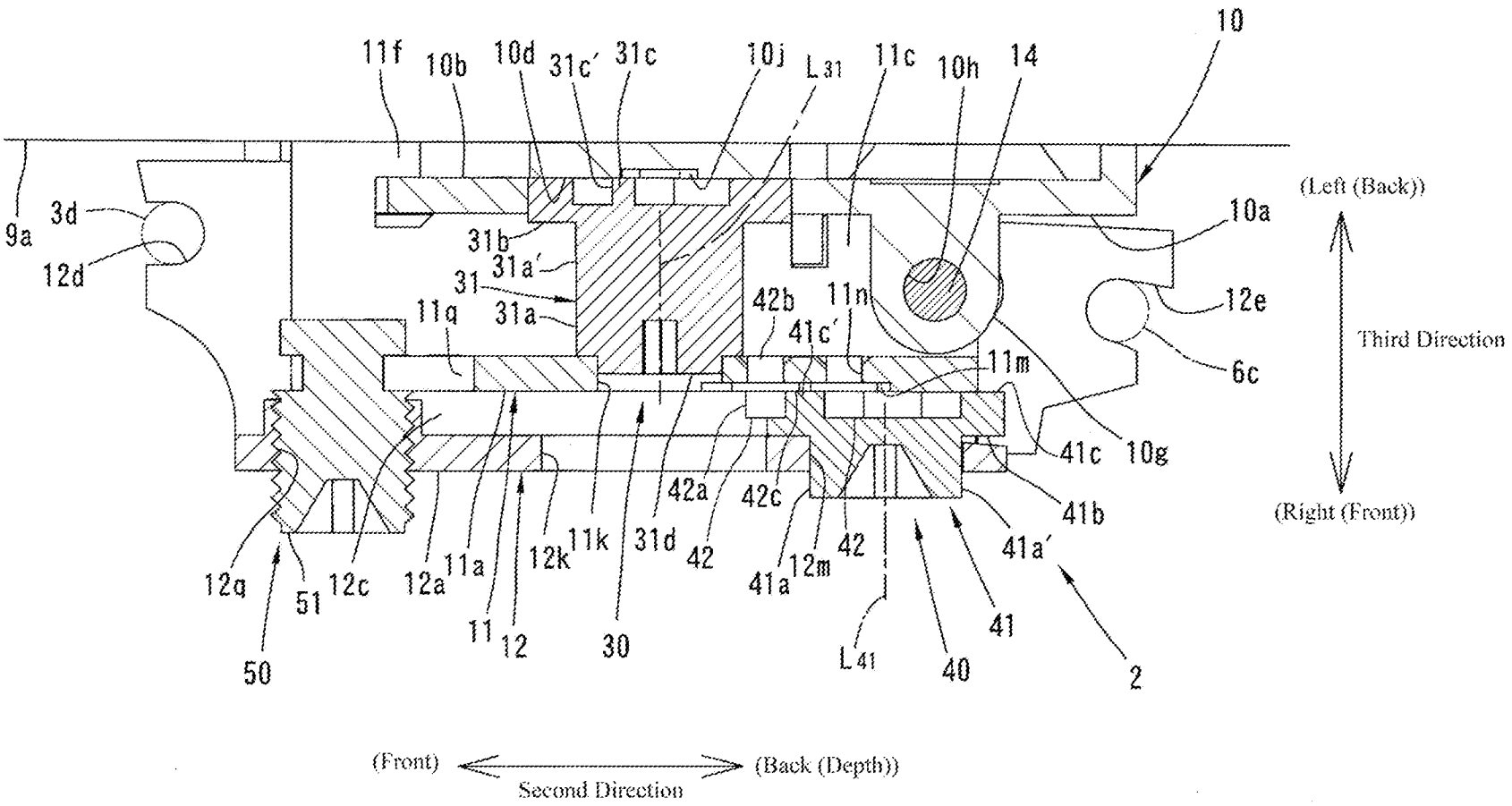
FIG. 8 is a cross-sectional plan view of the hinge device base along the line VIII-VIII of FIG. 7A.
Figure 9:
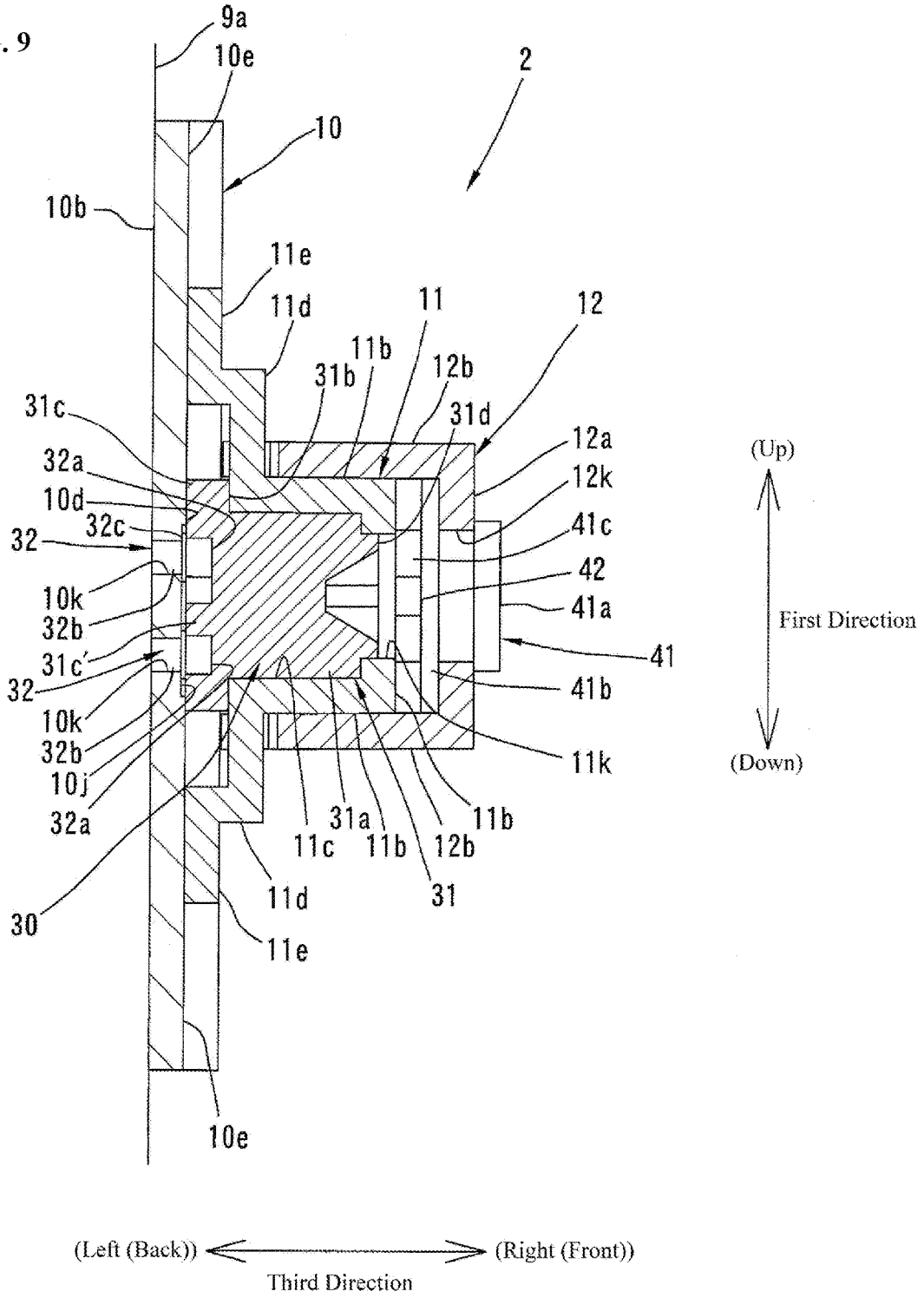
FIG. 9 is a vertical cross-sectional view of the hinge device base along the line IX-IX of FIG. 7A.

As shown in FIG. 8 and FIG. 9, the first movable member 11 is provided at the front of the substrate 10, and the second movable member 12 is provided at the front of the first movable member 11. The first movable member 11 engages with the substrate 10 so as to be capable of moving in the first direction (vertically), incapable of moving in the second direction (front and back direction), and incapable of moving in the third direction (left and right direction). The second movable member 12 engages with the first movable member 11 so as to be incapable of moving in the first direction (vertically), capable of moving in the second direction (front and back direction), and capable of moving in the third direction (left and right direction). The body part 3 is removably attached to this second movable member 12. In other words, the body part 3 is removably attached indirectly to the first movable member 11.

As shown in FIG. 2 and FIG. 5, a first position adjusting mechanism 30 is interposed between the substrate 10 and the first movable member 11. Through the first position adjusting mechanism 30, the position of the first movable member 11 in the first direction (vertical direction) with respect to the substrate 10 is adjusted. A second position adjusting mechanism 40 is interposed between the first movable member 11 and the second movable member 12. Through the second position adjusting mechanism 40, the position of the second movable member 12 in the second direction (front and back direction) with respect to the first movable member 11 is adjusted. Furthermore, a third position adjusting mechanism 50 is interposed between the first movable member 11 and the second movable member 12. Through the third position adjusting mechanism 50, the position of the second movable member 12 in the third direction (right and left direction) with respect to the first movable member 11 is adjusted. Accordingly, through the base 2 including these three position adjusting mechanisms 30, 40, 50, the position of the body part 3 can be adjusted in three directions, namely the first direction (vertical direction), the second direction (front and back direction), and the third direction (right and left direction). Consequently, the position of the door 9*b* can be adjusted in three directions with respect to the side wall 9*a*.

The structure of the hinge device base 2 is described below in greater detail.

As shown in FIG. 6, a shaft guiding recessed section 10*d* and fitting recessed sections 10*e*, 10*e* are formed in the front side surface 10*a* of the substrate 10. The shaft guiding recessed section 10*d* is arranged at the center part of the front side surface 10*a*, and has a rectangular or oval shape with the dimension in the first direction (vertical direction) being longer than the dimension in the second direction (front and back direction).

A pair of fitting recessed sections 10*e*, 10*e* is provided in both side directions of the first direction of the shaft guiding recessed section 10*d*. These fitting recessed sections 10*e*, 10*e* join the shaft guiding recessed section 10*d*, extend from the shaft guiding recessed section 10*d* in a groove shape to both sides in the first direction, and reach both edges in the first direction (vertical direction) of the substrate 10. The depth of the fitting recessed section 10*e* and the depth of the shaft guiding recessed section 10*d* are mutually the same, and the bottom face of the fitting recessed section 10*e* and the bottom face of the shaft guiding recessed section 10*d* are mutually flush. The width dimension along the second direction (front and back direction) of the fitting recessed section 10*e* is smaller than the dimension in the same direction of the shaft guiding recessed section 10*d*, and the shaft guiding recessed section 10*d* projects more in the forward direction than the front side edge (left in FIG. 6) with respect to the fitting recessed section 10*e*. A step is formed between the front side edge of the shaft guiding recessed section 10*d* and the front side edge of the fitting recessed section 10*e*. The back side edge (right in FIG. 6) with respect to the fitting recessed section 10*e* joins linearly with the back side edge of the shaft guiding recessed section 10*d*.

Note that the shaft guiding recessed section 10*d* may also project from the fitting recessed section 10*e* to the back side (right in FIG. 6).

As shown in FIG. 5 and FIG. 9, the first movable member 11 has a surface plate part 11*a* and a pair of side plate parts 11*b*, 11*b* and extends in one direction, and the profile orthogonal to the longitudinal direction thereof is roughly U-shaped. This first movable member 11 is arranged on the front side surface 10*a* of the substrate 10 with the longitudinal direction heading in the second direction (front and back direction) so as to be capable of moving in the first direction (vertical direction). A center part in the longitudinal direction of the first movable member 11 covers the shaft guiding recessed section 10*d*. The surface plate part 11*a* faces the front (right in FIG. 9), and the pair of side plate parts 11*b*, 11*b* are mutually facing in the first direction (vertical direction). An internal space 11*c* is formed by three plate parts 11*a*, 11*b*, 11*b*. The internal space 11*c* opens towards the back, or in other words, towards the front side surface 10*a* of the substrate 10, and is also opened towards both ends of the second direction (front and back direction).

Fitting sections 11*d*, 11*d* are integrally provided at the center of the first movable member 11 in the longitudinal direction. The fitting sections 11*d*, 11*d* form a pair, and are integrally formed with both sides in the first direction of the first movable member 11, or in other words, with side plate parts 11*b*, 11*b*. These fitting sections 11*d*, 11*d* project outward along the first direction (vertical direction) from respectively corresponding edges of the side plate parts 11*b* at the side opposite the surface plate part 11 (the substrate 10 side). The center part of each fitting section 11*d* bends in a stepped shape, and a tip end part 11*e* further at the tip end side than the bent part projects from the bent part to the back (left of FIG. 9) with respect to the portion of the base end side (side plate part 11*b* side). As shown in FIG. 7A and FIG. 9, the tip end part 11*e* of the upper fitting section 11*d* is fitted more into the upper fitting recessed section 10*e* than the shaft guiding recessed section 10*d* so as to be capable of sliding in the first direction (vertical direction). The tip end part 11*e* of the lower fitting section 11*d* is fitted more into the lower fitting recessed section 10*e* than the shaft guiding recessed section 10*d* so as to be capable of sliding in the first direction (vertical direction). By fitting together the fitting section 11*d* and the fitting recessed section 10*e*, the first movable member 11 is capable of moving in the first direction (vertical direction) with respect to the substrate 10, and movement in the second direction (front and back direction) is hindered.

As shown in FIG. 5 and FIG. 6, a locking recess 10*f* is formed at a center part of the front end edge of the substrate 10. On the other hand, as shown in FIG. 5 and FIG. 7B, respective L-shaped locking protrusions 11*f* are formed at the front end parts (one end part in the second direction) of the pair of side plate parts 11*b*, 11*b* of the first movable member 11. The locking protrusion 11*f* catches on the edge of the locking recess 10*f* (edge in the second direction of the substrate 10) so as to be capable of sliding in the first direction (vertical direction). Through this catching, movement of the first movable member 11 toward the back (right in FIG. 7B) with respect to the substrate 10 and movement in the third direction (direction orthogonal to the surface of the paper in FIG. 7B) are hindered.

Furthermore, as shown in FIG. 5 and FIG. 6, a cut and raised shape connection projection 10*g* is formed so as to project to the front (front direction of the paper surface in FIG. 6) further at the back end side (right side of FIG. 6) than the recesses 10*d*, 10*e* in the substrate 10. The connection projection 10*g* is formed in a piece type plate shape orthogonal to the first direction. A circular connection hole 10*h* is formed in this connection projection 10*g*. As shown in FIG. 5, respective circular connection holes 11*h* are formed at the back end parts (other end in the second direction) of the pair of side plate parts 11*b*, 11*b* of the first movable member 11. A connection pin 14 is inserted, with the shaft line oriented in the first direction (vertical direction), into the connection hole 10*h* and connection holes 11*h*, 11*h*. In other words, the connection pin 14 pierces the first movable member 11 and the connection projection 10*g* in the first direction. Through this connection pin 14, movement of the first movable member 11 towards the second direction (front and back direction) and the third direction (left and right direction) with respect to the substrate 10 is hindered. Moreover, the connection pin 14 is capable of sliding in the first direction (vertical direction) along the shaft line of the connection pin 14 with respect to the connection projection 10*g*, and through this, movement of the first movable member 11 in the first direction (vertical direction) with respect to the substrate 10 is allowed. A head part 14*a* of the connection pin 14 catches on an outside surface of one of the side plate parts 11*b* of the first movable member 11. Moreover, a leg part tip end 14*c* of the connection pin 14 is expanded diametrically by a mechanical fastener and catches on an outer surface of the other side plate part 11*b* of the first movable member 11. Accordingly, when the first movable member 11 moves in the first direction (vertical direction) with respect to the substrate 10, the connection pin 14 becomes integrated with the first movable member 11 and is moved in the first direction (vertical direction).

As shown in FIG. 5, the second movable member 12 is disposed at the side opposite the substrate 10 (in other words, at the front of the first movable member 11) with the first movable member 11 in between. As shown in FIG. 8 and FIG. 9, the second movable member 12 has a surface plate part 12*a* and a pair of side plate parts 12*b*, 12*b*, it extends in the same direction as the first movable member 11 (front and back direction), and the profile orthogonal to the longitudinal direction thereof is roughly U-shaped. The surface plate part 12*a* is oriented toward the front (right in FIG. 9), and the pair of side plate parts 12*b*, 12*b* are mutually facing in the first direction (vertical direction). An internal space 12*c* is formed by the three plate parts 12*a*, 12*b*, 12*b*. The internal space 12*c* is opened toward the back, or in other words, toward the substrate 10 side (left in FIG. 9), and is also opened toward both ends in the second direction (front and back direction). This second movable member 12 covers the first movable member 11, and the first movable member 11 is housed in the internal space 12*c*.

As shown in FIG. 9, the distance between the inside surfaces of the pair of side plate parts 12*b*, 12*b* is roughly equivalent to the distance between the outside surfaces of the side plate parts 11*b*, 11*b* of the first movable member 11. The upper side plate part 12*b* abuts the outside surface of the upper side plate part 11*b*, and the lower side plate part 12*b* abuts the outside surface of the lower side plate part 11*b*. Through this, movement of the second movable member 12 in the first direction (vertical direction) with respect to the first movable member 11 is hindered. Accordingly, when the first movable member 11 moves in the first direction (vertical direction) with respect to the substrate 10, the second movable member 12 moves together with the first movable member 11 in the first direction (vertical direction) with respect to the substrate 10. On the other hand, movement of the second movable member 12 with respect to the first movable member 11 is allowed by sliding the side plate part 12*b* along the side plate part 11*b* in the second direction (front and back direction) and the third direction (left and right direction).

Respective elongated hole shaped connection holes 12*h* are formed in the back end parts of the pair of side plate parts 12*b*, 12*b* of the second movable member 12. The major axis of the connection hole 12*h* is oriented in the second direction (front and back direction), and the minor axis is oriented in the first direction (vertical direction). The width dimension along the minor axis of the connection hole 12*h* is larger than the diameter of the connection hole 11*h* of the first movable member 11, and is roughly equivalent to the diameter of the head part 14*a* of the connection pin 14. This connection pin head part 14*a* is housed inside the connection hole 12*h* of one of the side plate parts 12*b* of the second movable member 12 so as to be capable of sliding along the major axis of the connection hole 12*h*. Moreover, the leg part tip end 14*c* expanded diametrically by a mechanical fastener at the connection pin 14 is housed inside the connection hole 11*h* of the other side plate part 12*b* of the second movable member 12 so as to be capable of sliding along the major axis of the connection hole 12*h*. Through this connection pin 14, the substrate 10, the first movable member 11, and the second movable member 12 are mutually linked so as to be incapable of separating. The second movable member 12 is capable of moving in the second direction (front and back direction) with respect to the substrate 10 and the first movable member 11, between the position at which the back end edge of the connection hole 12*h* collides with the connection pin 14 and the position at which the front end edge of the connection hole 12*h* collides with the connection pin 14.

The connecting structure between the hinge device base 2 and the body part 3 is configured as described below.

As shown in FIG. 3, respective connection recesses 12*d* (connection parts) are formed at the front end parts of the pair of side plate parts 12*b*, 12*b* of the second movable member 12. A fitting pin 3*d* of the front end part of the body part 3 is inserted into these connection recesses 12*d*, 12*d*. Moreover, respective connection recesses 12*e* (connection parts) are formed at the back end parts of the pair of side plate parts 12*b*, 12*b*. Meanwhile, as shown in FIG. 2 and FIG. 4, an operating member 6 is rotatably provided at the back end part of the body part 3 via a support pin 3*e*. This operating member 6 is biased in the counterclockwise direction of FIG. 2 by a torsion coil spring 6S, and a fitting shaft 6*c* of the operating member 6 is inserted into the connection recess 12*e*. In this manner, the body part 3 is stably mounted to the second movable member 12 and to the hinge device base 2. When the operating member 6 is rotated in the clockwise direction of FIG. 2 in opposition to the biasing of the torsion coil spring 6S, the fitting shaft 6*c* disconnects from the connection recess 12*e*, and the body part 3 can be separated from the second movable member 12 and the hinge device base 2.

The position adjusting mechanism 30 for adjusting the position in the first direction (vertical direction) of the hinge device 1 is configured as described below.

Figure 10A:
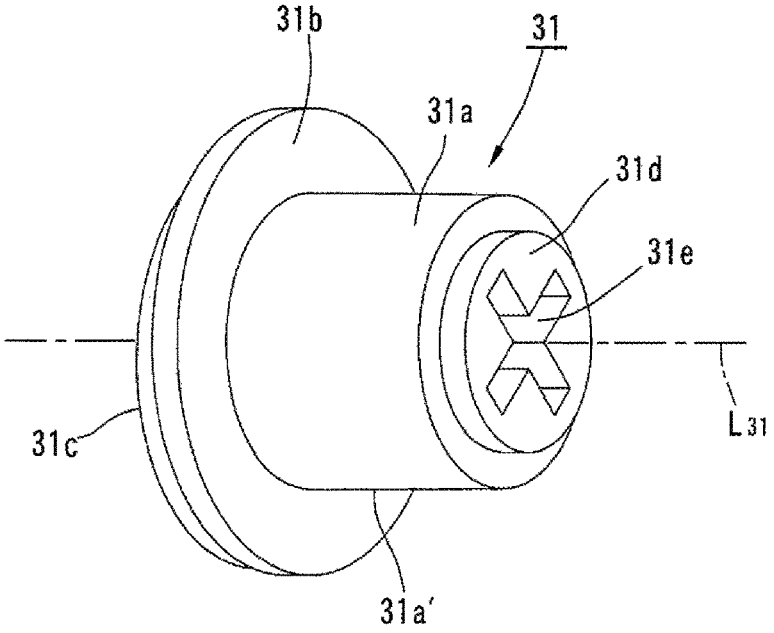
FIG. 10A is a perspective view of a first adjusting shaft of the hinge device base as viewed from the front and forward direction.
Figure 10B:
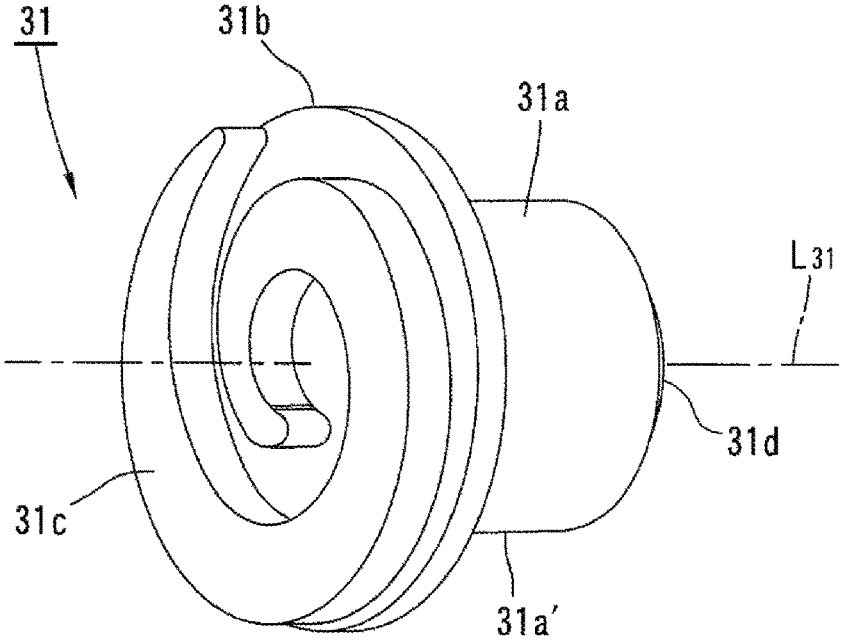
FIG. 10B is a perspective view of the first adjusting shaft as viewed from the back and forward direction.

As shown in FIG. 5, the first position adjusting mechanism 30 is provided with a first adjusting shaft 31, and a pair of substrate side guiding sections 32, 32. As shown in FIGS. 10A-10B, the first adjusting shaft 31 is provided integrally with a first shaft part 31*a* and a first shaft-side guiding section 31*c*. The first shaft part 31*a* includes a cylindrical part 31*a*', a disk part 31*b*, and a projecting shaft part 31*d*. The disk part 31*b*, which has a larger diameter than the cylindrical part 31*a*', is integrally provided at the back of the cylindrical part 31*a*' (left in FIG. 10A), and the circular projecting shaft part 31*d*, which has a smaller diameter than the cylindrical part 31*a*', is integrally provided at the front of the cylindrical part 31*a*' (right in FIG. 10A). This cylindrical part 31*a*', disk part 31*b*, and projecting shaft part 31*d* are mutually arranged on the same center shaft line (first rotation axis line $L_{31}$).

As shown in FIG. 9, the diameter of the cylindrical part 31*a*' is roughly equivalent to the distance between the inside surfaces of the pair of side plate parts 11*b*, 11*b* of the first movable member 11. Moreover, as shown in FIG. 8, the diameter of the disk part 31*b* is roughly equivalent to the width dimension along the second direction (front and back direction) of the shaft guiding recessed section 10*d*. As shown in FIG. 10B, the first shaft-side guiding section 31*c* is integrally provided at the back surface (left side surface in FIG. 10B) of the disk part 31*b*. The first shaft-side guiding section 31*c* projects from the disk part 31*b*, and is spiral shaped.

As shown in FIG. 10A, a cross-shaped groove 31*e* is formed in the top surface facing the front (right side) of the projecting shaft part 31*d*.

As shown in FIG. 8 and FIG. 9, this first adjusting shaft 31 is interposed between the first movable member 11 and the substrate 10 with the center shaft line $L_{31}$ oriented in the third direction (left and right direction). The cylindrical part 31*a*' of the first adjusting shaft 31 is housed in the internal space 11*c* of the first movable member 11. A pair of side plates 11*b*, 11*b* of the first movable member 11 roughly abuts the cylindrical part 31*a*' from both sides in the first direction (vertical direction). The disk part 31*b* and the first shaft-side guiding section 31*c* are housed in the shaft guiding recessed section 10*d*. Furthermore, a front side edge and a back side edge of the shaft guiding recessed section 10*d* roughly abut the disk part 31*b* from both sides in the second direction. Accordingly, the first adjusting shaft 31 is capable of moving in the first direction (vertical direction) such that it is capable of being guided along the front side edge and the back side edge of the shaft guiding recessed section 10*d* with respect to the substrate 10, and is not capable of moving in the second direction (front and back direction).

A shaft support hole 11*k* is formed at a center part in the longitudinal direction (second direction) of the surface plate part 11*a* of the first movable member 11. The projecting shaft part 31*d* is rotatably inserted into this shaft support hole 11*k*. A step between the circumferential side surface of the projecting shaft part 31*d* and the cylindrical part 31*a*' catches on a circumferential edge of the shaft support hole 11*k* of the surface plate part 11*a*. Through this, the first shaft part 31*a* and the first adjusting shaft 31 engages with the first movable member 11 so as to be capable of rotating around the first rotation axis line $L_{31}$, and so as to be incapable of moving in the first direction (vertical direction) and second direction (front and back direction). Accordingly, the first rotation axis line $L_{31}$ is capable of moving only in the first direction with respect to the substrate 10.

As shown in FIG. 5, the abovementioned pair of substrate side guiding sections 32, 32, is interposed between the first adjusting shaft 31 and the substrate 10. These substrate side guiding sections 32, 32 are configured of members separate from the substrate 10, and are integrated with the substrate 10. In other words, each substrate side guiding section 32 includes a guiding portion 32*a* and a leg part 32*b*. The guiding portion 32*a* is formed in a small cylindrical shape, and a flange part 32*c* is provided at the back end part thereof so as to project radially outward. The leg part 32*b* projects from the back surface of the guiding portion 32*a*. The guiding portions 32*a*, 32*a* of the pair of substrate side guiding sections 32, 32 are disposed in the shaft guiding recessed section 10*d* so as to be slightly separated and mutually facing in the first direction (vertical direction).

Meanwhile, an oval shaped mounting recess 10*j* long in the first direction (vertical direction) is formed in the bottom face of the shaft guiding recessed section 10*d* of the substrate 10. A pair of small circular mounting holes 10*k*, 10*k* is formed in the bottom face of this mounting recess 10*j*. These mounting holes 10*k*, 10*k* are disposed so as to be mutually separated slightly in the first direction (vertical direction), and respectively penetrate the substrate 10 in the thickness direction (third direction). As shown in FIG. 9, the flange part 32*c* of the two substrate side guiding sections 32 is accommodated in the mounting recess 10*j*, and the leg part 32*b* is inserted into the respectively corresponding mounting hole 10*k*. This leg part 32*b* is fixed to the substrate 10 by a mechanical fastener or the like.

Furthermore, the first shaft-side guiding section 31*c* of the first adjusting shaft 31 is inserted between the guiding portions 32*a*, 32*a* of the pair of substrate side guiding sections 32, 32. In this manner, the first shaft-side guiding section 31*c* and the substrate side guiding sections 32, 32 are engaged. An engaging part 31*c*' of the first shaft-side guiding section 31*c* with the substrate side guiding sections 32, 32 is eccentric with respect to the first rotation axis line $L_{31}$. The first shaft-side guiding section 31*c* and the substrate side guiding sections 32, 32 mutually engage and guide, and thereby rotation of the first adjusting shaft 31 is converted to parallel movement of the first adjusting shaft 31 along the first face 10*a*.

As shown in FIG. 3, a window hole 12*k* is formed in the surface plate part 12*a* of the second movable member 12. The window hole 12*k* is formed as an elongated hole extending in the second direction (front and back direction). Furthermore, a window hole 3*k* is formed in the body part 3. The window hole 3*k* is formed as an elongated hole extending in the second direction (front and back direction).

As shown in FIG. 1 and FIG. 2, the window hole 3*k* and the window hole 12*k* overlap the shaft support hole 11*k* in the third direction (left and right direction). In this manner, the projecting shaft part 31*d* is exposed at the front (front direction of the paper surface in FIG. 1) through the window holes 3*k*, 12*k*. The first adjusting shaft 31 can be rotated around the first rotation axis line $L_{31}$ by inserting a screw rotation tool such as a Phillips-head screwdriver through the window holes 3*k*, 12*k* and into the cross-shaped groove 31*e*, and then rotating the tool. When this is done, the engaging part 31*c*' is displaced in the circumferential direction of the spiral-shaped first shaft-side guiding section 31*c*, and as a result, the distance between the engaging part 31*c*' and the first rotation axis line $L_{31}$ changes. In other words, the first rotation axis line $L_{31}$ displaces with respect to the substrate side guiding section 32. Meanwhile, because the movable direction of the first rotation axis line $L_{31}$ is restricted to only the first direction, the first adjusting shaft 31 moves in the first direction (vertical direction) with respect to the substrate 10 by the abovementioned transformation action in the movement direction between the first shaft-side guiding section 31*c* and the substrate side guiding section 32. Along with this first adjusting shaft 31, the first movable member 11, second movable member 12, and body part 3 also move in the first direction (vertical direction). In association therewith, the pair of fitting sections 11*d*, 11*d* are guided in the first direction (vertical direction) along the respective fitting recessed sections 10*e*. By adjusting the position of the body part 3 in the first direction (vertical direction) with respect to the substrate 10, the position of the door 9*b* can be adjusted in the first direction (vertical direction) with respect to the side wall 9*a*.

Note that in place of a screwdriver, a hexagonal wrench or other screw rotation tool can be used to rotate the first adjusting shaft 31.

The position adjusting mechanism 40 for adjusting the position in the second direction (front and back direction) with respect to the hinge device 1 is configured as described below.

Figure 11A:
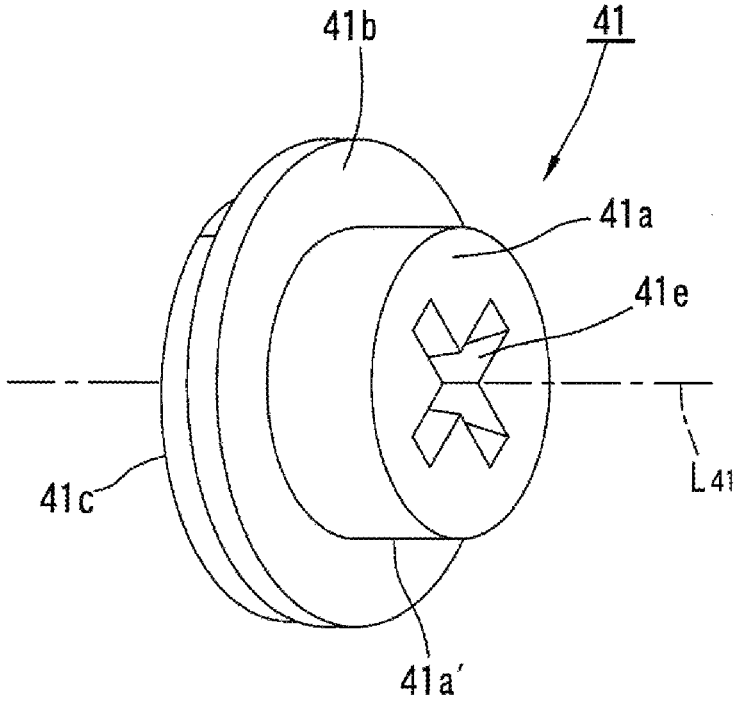
FIG. 11A is a perspective view of a second adjusting shaft of the hinge device base as viewed from the front and forward direction.
Figure 11B:
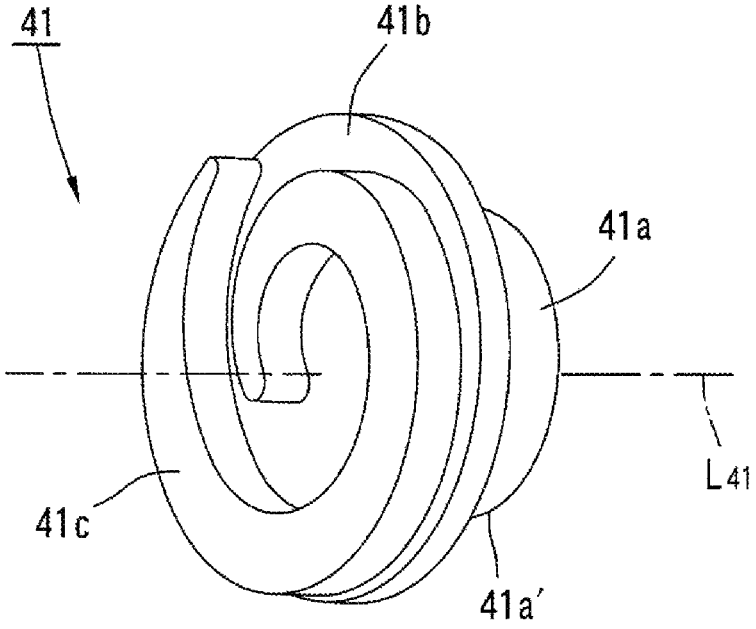
FIG. 11B is a perspective view of the second adjusting shaft as viewed from the back and forward direction.

As shown in FIG. 5, the second position adjusting mechanism 40 is provided with a second adjusting shaft 41, and a pair of first movable side guiding sections 42, 42. As shown in FIGS. 11A-11B, the second adjusting shaft 41 is provided integrally with a second shaft part 41*a* and a second shaft-side guiding section 41*c*. The second shaft part 41*a* includes a cylindrical part 41*a*' and a disk part 41*b*. The cylindrical part 41*a*' and the disk part 41*b* are mutually arranged on the same center shaft line (second rotation axis line $L_{41}$). The shaft length of the cylindrical part 41*a*' is shorter than the shaft length of the cylindrical part 31*a*' of the first adjusting shaft 31. As shown in FIG. 11A, a cross-shaped groove 41*e* is formed in the front side surface of the cylindrical part 41*a*'. The disk part 41*b*, which has a larger diameter than the cylindrical part 41*a*', is integrally provided at the back of the cylindrical part 41*a*' (left of FIG. 11A). Furthermore, as shown in FIG. 9, the diameter of the disk part 41*b* is larger than the diameter of the disk part 31*b* of the first adjusting shaft 31, and is roughly equivalent to the distance between the inside surfaces of the pair of side plate parts 12*b*, 12*b* of the second movable member 12. As shown in FIG. 11B, a second shaft-side guiding section 41*c* is integrally provided at the back surface of this disk part 41*b* (left side surface in FIG. 11A). The second shaft-side guiding section 41*c* projects from the disk part 41*b* and is spiral shaped.

As shown in FIG. 5 and FIG. 8, this second adjusting shaft 41 is interposed between the first and second movable members 11, 12 with the center shaft line thereof (second rotation axis line $L_{41}$) oriented so as to be parallel (third direction) with the first rotation axis line $L_{31}$. As shown in FIG. 7A, when viewed from the front (front direction of the paper surface in FIG. 7A), the second position adjusting mechanism 40 is arranged deviated to the back end side in the second direction (right side in FIG. 7A) with respect to the first position adjusting mechanism 30. Furthermore, as shown in FIG. 8 and FIG. 9, the disk part 41*b* and the second shaft-side guiding section 41*c* of the second adjusting shaft 41 are housed in the internal space 12*c* of the second movable member 12 so as to be sandwiched between the surface plate part 12*a* of the second movable member 12 and the surface plate part 11*a* of the first movable member 11. Furthermore, the pair of side plate parts 12*b*, 12*b* of the second movable member 12 roughly abuts the disk part 41*b* from both sides in the second direction.

Meanwhile, a shaft support hole 12*m* is formed in the back end part of the surface plate part 12*a* of the second movable member 12. The cylindrical part 41*a*' is inserted into this shaft support hole 12*m*. A step between the circumferential side surface of the cylindrical part 41*a*' and the disk part 41*b* catches on the circumferential edge of the shaft support hole 12*m* at the surface plate part 12*a*. In this manner, the second shaft part 41*a* and the second adjusting shaft 41 engage such that they are able to rotate around the second rotation axis line $L_{41}$ with respect to the second movable member 12, and are unable to move in the first direction (vertical direction) and the second direction (front and back direction). Furthermore, the second adjusting shaft 41 is able to move in the second direction (front and back direction) with respect to the first movable member 11 together with the second movable member 12. Accordingly, with respect to the first movable member 11, the second rotation axis line $L_{41}$ is able to move only in the second direction (front and back direction) with the exception of the third direction.

As shown in FIG. 5, the abovementioned pair of first movable side guiding sections 42, 42, is interposed between the second adjusting shaft 41 and the first movable member 11. These first movable side guiding sections 42, 42 are configured of members separate from the first movable member 11, and are integrated with the first movable member 11. In other words, each first movable side guiding section 42 includes a guiding portion 42*a* and a leg part 42*b*. The guiding portion 42*a* is formed in a small cylindrical shape, and a flange part 42*c* is provided at the back end part thereof so as to project radially outward. The leg part 42*b* projects from the back surface of the guiding portion 42*a*. The guiding portions 42*a*, 42*a* of the pair of first movable side guiding sections 42, 42 are disposed slightly separated and mutually facing in the second direction (front and back direction), and respectively project to the front of the first movable member 11.

Meanwhile, an oval shaped mounting recess 11*m* is formed in the front side surface of the surface plate part 11*a* of the first movable member 11 so as to extend from the shaft support hole 11*k* to the back end side. A pair of small circular mounting holes 11*n*, 11*n* is formed in the bottom face of this mounting recess 11*m*. These mounting holes 11*n*, 11*n* are disposed so as to be mutually separated slightly in the second direction (front and back direction), and respectively penetrate the surface plate part 11*a* in the thickness direction. As shown in FIG. 8, the flange part 42*c* of the two first movable side guiding sections 42 is accommodated in the mounting recess 11*m*, and the leg part 42*b* is inserted into the respectively corresponding mounting hole 11*n*. This leg part 42*b* is fixed to the first movable member 11 by a mechanical fastener or the like.

Furthermore, the second shaft-side guiding section 41*c* of the second adjusting shaft 41 is inserted between the guiding portions 42*a*, 42*a* of the pair of first movable side guiding sections 42, 42. In this manner, the second shaft-side guiding section 41*c* and the first movable side guiding section 42, 42 are engaged. An engaging part 41*c*' with the first movable side guiding sections 42,42 with respect to the second shaft-side guiding section 41*c* is eccentric with respect to the second rotation axis line $L_{41}$. The second shaft-side guiding section 41*c* and the first movable side guiding sections 42, 42 mutually engage and guide, and thereby rotation of the second adjusting shaft 41 is converted to a parallel direction movement along the surface plate part 11*a* of the second adjusting shaft 41.

As shown in FIG. 1 and FIG. 2, a window hole 3*m* is formed further to the back end side than the window hole 3*k* in the body part 3. The window hole 3*m* overlaps the shaft support hole 12*m* in the third direction (left and right direction). In this manner, the second shaft part 41*a* is exposed through the window hole 3*m*. The second adjusting shaft 41 can be rotated around the second rotation axis line $L_{41}$ by inserting a screw rotation tool such as a Phillips-head screwdriver through the window hole 3*m* and into a cross-shaped groove 41*e*, and then rotating the tool. When this is done, the engaging part 41*c*' is displaced in the circumferential direction of the spiral-shaped second shaft-side guiding section 41*c*, and as a result, the distance between the engaging part 41*c*' and the second rotation axis line $L_{41}$ changes. In other words, the second rotation axis line $L_{41}$ displaces with respect to the first movable side guiding section 42. Meanwhile, because the movable direction of the second rotation axis line $L_{41}$ is restricted to only the second direction (front and back direction) with the exception of the third direction with respect to the first movable member 11, the second adjusting shaft 41 moves in the second direction (front and back direction) with respect to the first movable member 11 by the abovementioned transformation action in the movement direction between the second shaft-side guiding section 41*c* and the first movable side guiding section 42. Along with this second adjusting shaft 41, the second movable member 12 and body part 3 also move in the second direction (front and back direction) with respect to the first movable member 11. Through this, the position of the door 9*b* can be adjusted in the second direction (front and back direction) with respect to the side wall 9*a*.

Note that in place of a screwdriver, a hexagonal wrench or other screw rotation tool can be used to rotate the second adjusting shaft 41.

The position adjusting mechanism 50 for adjusting the position in the third direction (left and right direction) with respect to the hinge device 1 is configured as described below.

As shown in FIG. 5, the third position adjusting mechanism 50 is provided with a third adjusting screw 51. The third adjusting screw 51 is interposed between the first movable member 11 and the second movable member 12. Furthermore, as shown in FIG. 7A, as viewed from the front (the front direction of the paper surface of FIG. 7A), the third position adjusting mechanism 50 is disposed shifted to the front end side (left in FIG. 7A) of the second direction with respect to the first position adjusting mechanism 30.

Meanwhile, an opened slit 11*q* is formed in the front end part of the surface plate part 11*a* of the first movable member 11. The opened slit 11*q* reaches the front edge of the surface plate part 11*a* and is opened. Furthermore, a screw hole 12*q* is formed in the front end part of the surface plate part 12*a* of the second movable member 12. In addition, the third adjusting screw 51 is locked such that it is capable of rotating in the opened slit 11*q* of the first movable member 11, incapable of moving in the first direction (vertical direction), capable of moving in the second direction (front and back direction), and incapable of moving in the third direction (left and right direction), and is screwed into the screw hole 12*q* of the second movable member 12. As shown in FIG. 1 and FIG. 2, a window hole 3*q* is formed further to the front end side than the window hole 3*k* in the body part 3. The window hole 3*q* overlaps the screw hole 12*q* in the third direction (left and right direction). The head part of the third adjusting screw 51 is exposed through the window hole 3*q*. When a Phillips-head screwdriver or other screw rotation tool is inserted through the window hole 3*q*, and used to rotate the third adjusting screw 51, the second movable member 12 is displaced in the third direction (left and right direction) such that the connection pin 14 swings to the center. Through this, the position of the second movable member 12 in the third direction (left and right direction) with respect to the first movable member 11 and the substrate 10 can be adjusted.

According to the hinge device 1 of the present invention, the shaft guiding recessed section 10*d* of the substrate 10 and a pair of fitting recessed sections 10*e*, 10*e* are both formed on the front side surface 10*a*, and are mutually joined and integrated, and therefore, the substrate 10 can be easily machined. In other words, if the substrate 10 is manufactured through press machining, a mold portion corresponding to the shaft guiding recessed section 10*d* and a mold portion corresponding to each fitting recessed section 10*e* can be configured with a single convex part, and a press mold can be easily fabricated. Moreover, even if the substrate 10 is manufactured through cutting machining, the shaft guiding recessed section 10*d* and the pair of fitting recessed sections 10*e*, 10*e* can be integrally formed, and forming can be easily performed with one to a few cutting steps Moreover, because the bottom parts of the shaft guiding recessed section 10*d* and the fitting recessed section 10*e* are flush, machining can be further simplified. In other words, if the substrate 10 is manufactured by press machining, a mold portion corresponding to the shaft guiding recessed section 10*d* and a mold portion corresponding to the fitting recessed section 10*e* can be configured with a single convex part having an overall uniform height, and a press mold can be more easily fabricated. Moreover, even if the substrate 10 is manufactured through cutting machining, the shaft guiding recessed section 10*d* and the fitting recessed section 10*e* can be integrally formed with the same cutting depth.

After the substrate side guiding section 32 is attached to the substrate 10 fabricated as described above, the first adjusting shaft 31, the first movable member 11 to which the first movable side guiding section 42 has been installed, the second adjusting shaft 41, and the second movable member 12 are placed in order on the front of the substrate 10 such that they are stacked in the third direction, and next, the first and second movable members 11, 12 are connected by the third adjusting screw 51, and the substrate 10 and the movable members 11, 12 are connected by the connection pin 14, and thereby the base 2 can be easily assembled. Moreover, the second adjusting shaft 41 is sandwiched between the abovementioned first movable member 11 and second movable member 12 in advance, and is connected by the third adjusting screw 51, after which the unit is installed on the front side surface 10*a* of the substrate 10, and then the substrate 10 and movable members 11, 12 can be connected by the connection pin 14.

Furthermore, the first position adjusting mechanism 30 is interposed between the substrate 10 and the first movable member 11, and the second position adjusting mechanism 40 is interposed between the first movable member 11 and the second movable member 12, and therefore the assembly of the hinge device base 2 can be further simplified.

Here, when the first movable member 11 is attached to the substrate 10, the locking protrusion 11*f* catches on the locking recess 10*f* of the substrate 10, and the first moveable member 11 is made to cover from the front the first adjusting shaft 31 disposed in advance on the shaft guiding recessed section 10*d*, and the pair of fitting sections 11*d*, 11 *d* may be accommodated in the fitting recessed sections 10*e*, 10*e* from the front, and therefore there is no need to slide the first movable member 11 in the first direction with respect to the substrate 10. Accordingly, even if the first adjusting shaft 31 is installed in advance on the shaft guiding recessed section 10*d*, this first adjusting shaft 31 does not hinder the operation of attaching the first movable member 11 to the substrate 10.

With the hinge device base 2 assembled in this manner, the pair of fitting sections 11*d*, 11*d* fits to the respectively corresponding fitting recessed section 10*e* such that sliding in the first direction (vertical direction) is possible, and therefore the first movable member 11 can be stably moved parallel to the first direction (vertical direction). Accordingly, the positions of the body part 3 and the door 9*b* can be stably adjusted in the first direction (vertical direction).

The first position adjusting mechanism 30 is interposed between the substrate 10 and the first movable member 11, and the second position adjusting mechanism 40 is interposed between the first movable member 11 and the second movable member 12, and therefore position adjustment in the first direction and position adjustment in the second direction can be performed in a mutually independent manner.

The first to the third position adjusting mechanisms 30, 40, 50 are constructed only at the hinge device base 2 and do not straddle the hinge device base 2 and the body part 3, and therefore position adjustments of the body part 3 and the door 9*b* in three directions, namely the first to the third directions, can be performed with only the hinge device base 2.

Next, another embodiment of the present invention is described. For those configurations of the following embodiment that duplicate the already described aspect, the same reference numerals are assigned in the drawings, and the explanation is simplified.

Figure 12:
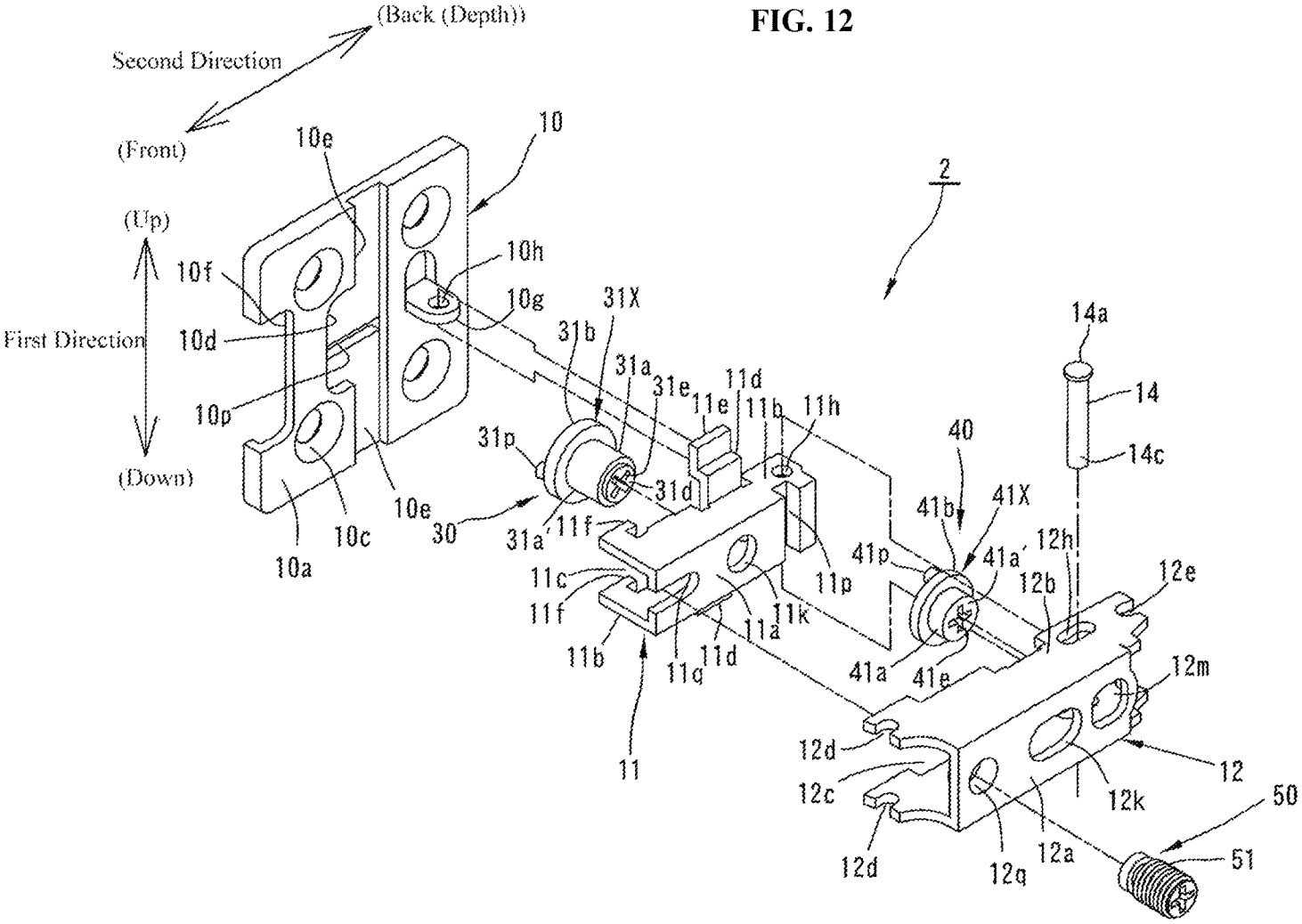
FIG. 12 is an exploded perspective view of a base of a hinge device according to a second embodiment of the present invention.
Figure 13A:
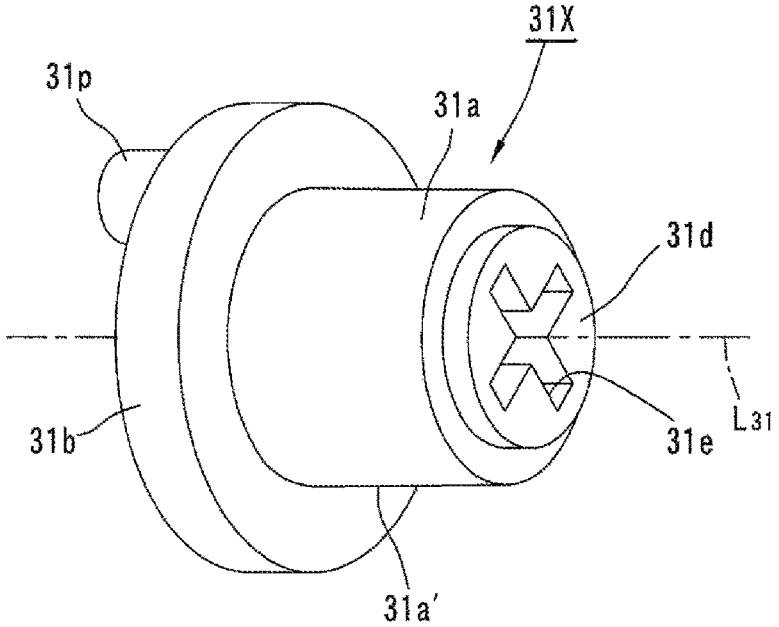
FIGS. 13A and 13B show a first adjusting shaft of the hinge device base according to the second embodiment.
Figure 13B:
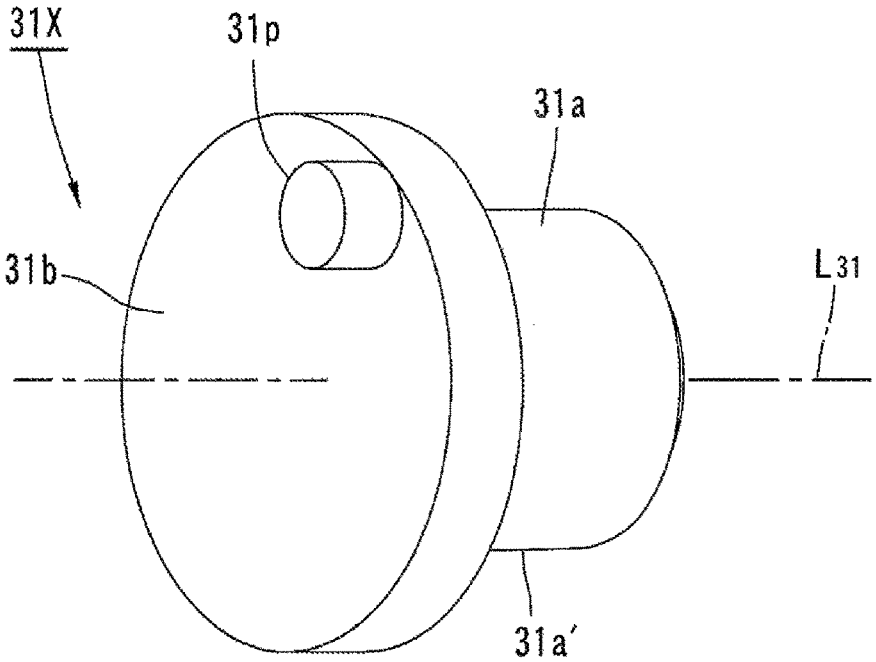

FIG. 12 to FIGS. 14A and 14B show a second embodiment of the present invention. The second embodiment pertains to a modified example of the first position adjusting mechanism 30 and the second position adjusting mechanism 40. As shown in FIG. 12, in place of the protrusion-shaped substrate side guiding section 32, a recess-shaped substrate side guiding section 10*p* is provided in the shaft guiding recessed section 10*d* of the substrate 10 in the second embodiment. The substrate side guiding section 10*p* extends linearly in the second direction (front and back direction), and forms a slit piercing the substrate 10 in the thickness direction (third direction). Moreover, as shown in FIGS. 13A-13B, in place of the above-described spiral-shaped first shaft-side guiding section 31*c*, a small, cylindrical first shaft-side guiding section 31*p* is formed in the disk part 31*b* of a first adjusting shaft 31X. The first shaft-side guiding section 31*p* is eccentric with respect to the shaft line (first rotation axis line $L_{31}$) of the first adjusting shaft 31X. The disk part 31*b* is accommodated in the shaft guiding recessed section 10*d*, and the first shaft-side guiding section 31*p* is inserted into the substrate side guiding section 10*p*. Accordingly, the first adjusting shaft 31X is capable of moving in the first direction (vertical direction) along the shaft guiding recessed section 10*d* with respect to the substrate 10 and is incapable of moving in the second direction (front and back direction). Moreover, the first shaft-side guiding section 31*p* is incapable of moving in the first direction (vertical direction) with respect to the substrate 10, and is capable of moving in the second direction (front and back direction). Furthermore, the projecting shaft part 31*d* of the first adjusting shaft 31X is rotatably inserted into the shaft support hole 11*k* of the first movable member 11. Through this, a transformation action in the movement direction between the first shaft-side guiding section 31*p* and the substrate side guiding section 10*p* is manifest by rotating the first adjusting shaft 31X around the first rotation axis line $L_{31}$, and the position of the first movable member 11 can be adjusted in the first direction (vertical direction) with respect to the substrate 10.

Figure 14A:
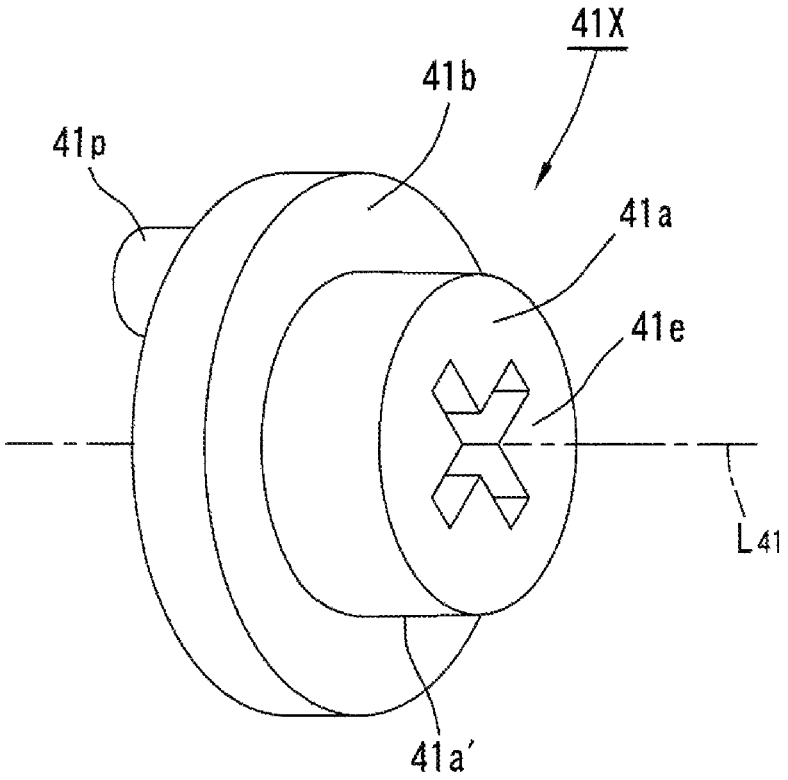
FIGS. 14A and 14B show a second adjusting shaft of the hinge device base according to the second embodiment.
Figure 14B:
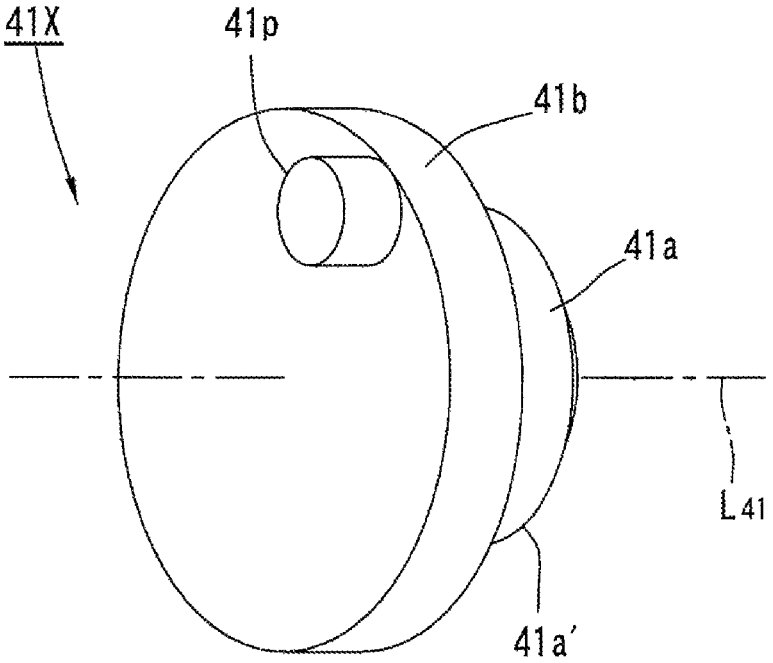

Also, as shown in FIG. 12, in place of the first movable side guiding section 42, a first movable side guiding section 11*p* is provided at the surface plate part 11*a* of the first movable member 11 of the second embodiment. The first movable side guiding section 11*p* forms a slit shape extending in the first direction (vertical direction). As shown in FIGS. 14A-14B, in place of the above-described spiral-shaped second shaft-side guiding section 41*c*, a small, cylindrical second shaft-side guiding section 41*p* is formed at the disk part 41*b* of a second adjusting shaft 41X. The second shaft-side guiding section 41*p* is eccentric with respect to the shaft line (second rotation axis line $L_{41}$) of the second adjusting shaft 41X. The second shaft part 41*a* of this second adjusting shaft 41X is rotatably inserted into the shaft support hole 12*m* of the second movable member 12. Moreover, the disk part 41*b* is interposed between the surface plate parts 11*a*, 12*a* and the between the pair of side plate parts 12*b*, 12*b*, and is accommodated in the internal space 12*c* of the second movable member 12. Accordingly, the second adjusting shaft 41X is capable of moving around the second rotation axis line $L_{41}$ with respect to the first movable member 11, is not capable of moving in the first direction (vertical direction), and is capable of moving in the second direction (front and back direction). Furthermore, the second shaft-side guiding section 41*p* is inserted into the first movable side guiding section 11*p*, and is thereby capable of moving in the first direction (vertical direction) with respect to the first movable member 11, and is incapable of moving in the second direction (front and back direction). In this manner, a transformation action in the movement direction between the second shaft-side guiding section 41*p* and the first movable side guiding section 11*p* is manifest by rotating the second adjusting shaft 41X around the second rotation axis line $L_{41}$, and the position of the second movable member 12 can be adjusted in the second direction (front and back direction) with respect to the first movable member 11.

Note that the present invention is not limited by the above-described embodiments, and various modifications can be adopted within a scope that does not depart from the gist thereof.

For example, the second movable member 12 may be omitted, and the body part 3 may be removably attached directly to the first movable member 11. Furthermore, the second position adjusting mechanism 40 or the third position adjusting mechanism 50 may be omitted. Or, the second position adjusting mechanism 40 or the third position adjusting mechanism 50 may be provided at the first movable member 11 between the movable member 11 and the body part 3.

The depth of the shaft guiding recessed section 10*d* and the depth of the fitting recessed section 10*e* may be mutually different, and a step may be formed between these recesses 10*d*, 10*e*.

The width dimensions along the second direction (front and back direction) of the shaft guiding recessed section 10*d* and the fitting recessed section 10*e* may be mutually equivalent. A groove having a uniform width overall may be formed in the front side surface 10*a* (first face) of the substrate 10 so as to extend in the first direction, a portion of the groove thereof (for example, the center part) may configure the shaft guiding recessed section 10*d*, and another portion of the groove thereof (for example, both sides) may configure the fitting recessed section 10*e*. In this case, the diameter of the disk part 31*b* of the first adjusting shaft 31 may not only be roughly equivalent to the width dimension along the second direction (front and back direction) of the shaft guiding recessed section 10*d*, but also roughly equivalent to the width dimension along the second direction (front and back direction) of the fitting recessed section 10*e*.

The shaft guiding recessed section 10*d* and the fitting recessed section 10*e* do not necessarily have to be joined, and may be mutually separated.

At least one fitting recessed section 10*e* need only be formed on the front side surface 10*a* (first face) of the substrate 10. Likewise, at least one fitting section 11*d* need only be provided at the first movable member 11, The fitting section 11*d* need only fit to the fitting recessed section 10*e* such that it is capable of sliding in the first direction, and does not necessarily have to project in the first direction from the side plate part 11*b* of the first movable member 11, and for example, the fitting section 11*d* may project straight to the back in the third direction from the side plate parts 11*b*.

The substrate side guiding section 32 may be integrally formed with the substrate 10. Furthermore, the first movable side guiding section 42 may be integrally formed with the first movable member 11.

As long as the rotation of the first adjusting shaft 31 is converted to parallel movement along the first face 10*a* of the first adjusting shaft 31 through mutual engagement and guidance of the substrate side guiding section and the first shaft-side guiding section, the specific aspect of the present invention is not limited to the above-described first and second embodiments. For example, as the substrate side guiding section, a spiral-shaped projection may be provided at the shaft guiding recessed section 10*d*, and as the first shaft-side guiding section engaging therewith, a small, cylindrical projection may be eccentrically provided at the back surface of the first adjusting shaft 31.

As long as the rotation of the second adjusting shaft 41 is converted to parallel movement along the first face 10*a* of the second adjusting shaft 41 through mutually engagement and guidance of the first movable side guiding section and the second shaft-side guiding section, the specific aspect of the present invention is not limited to the above-described first and second embodiments. For example, as the first movable side guiding section, a spiral-shaped projection may be provided at the first movable member 11, and as the second shaft-side guiding section engaging therewith, a small, cylindrical projection may be eccentrically provided at the back surface of the second adjusting shaft 41.

The above-described embodiments were explained with the first direction being the vertical direction, the second direction being the front and back direction, and the third direction being the left and right direction, but the first to third directions of the present invention are not limited thereto.

The present invention can be applied to hinges for rotatably connecting a door to a side wall of furniture or the like, for example.

What is claimed is:

1. A hinge device base comprising a substrate having a substantially planar first face comprising a side facing away from a mounting surface, a first movable member provided on the first face capable of moving in a first direction along the first face with respect to the substrate, and a first position adjusting mechanism for adjusting a position of the first movable member in the first direction with respect to the substrate, with the first movable member removably connected either indirectly or directly to a body part that is rotatably connected to an attachment member;

a shaft guiding recessed section and a fitting recessed section that extends from the shaft guiding recessed section, with both formed on the first face of the substrate;

the shaft guiding recessed section and the fitting recessed section each having a front side edge and a back side edge spaced apart in a second direction orthogonal to the first direction along the first face;

a substrate side guiding section is provided on the shaft guiding recessed section, and a first adjusting shaft is provided between the substrate and the first movable member, with the first adjusting shaft including a first shaft part that rotatably engages to the first movable member around a first rotation axis line orthogonal to the first face and is inserted into the shaft guiding recessed section so as to be guided in the first direction, and a first shaft-side guiding section which engages with the substrate side guiding section; and a fitting section located in the first movable member, and the fitting section is inserted into the fitting recessed section so as to be able to slide in the first direction.

2. The hinge device base according to claim 1, wherein the shaft guiding recessed section and the fitting recessed section are joined such that the mutual bottom faces thereof become flush.

3. The hinge device base according to claim 2, wherein the fitting recessed section is provided as a pair at both sides of the shaft guiding recessed section in the first direction, the fitting section is provided as a pair at both sides of the first movable member in the first direction, and each fitting section is inserted into the corresponding fitting recessed section so as to be capable of sliding in the first direction.

4. The hinge device base according to claim 3, wherein the first movable member runs along the first face and extends in the second direction orthogonal to the first direction, and a locking protrusion is formed at one end of the first movable member in the second direction, and the locking protrusion catches on an edge of the substrate in the second direction so as to be capable of sliding in the first direction; and a connection projection is further provided at the substrate, and the other end of the first movable member in the second direction is connected by a connection pin, extending in the first direction, to the connection projection so as to be capable of moving in the first direction.

5. The hinge device base according to claim 1, wherein the base further comprises a second movable member running along the first face with respect to the first movable member and capable of moving in the second direction orthogonal to the first direction, and a second position adjusting mechanism for adjusting a position of the second movable member in the second direction with respect to the first movable member, and the second movable member has a connection part removably connected to the body part, sandwiching the first movable member, and is provided at a side opposite the substrate; and a first movable side guiding section is provided at the first movable member, and a second adjusting shaft is provided between the first movable member and the second movable member, and the second adjusting shaft includes a second shaft part rotatably engaged to the second movable member around a second rotation axis line parallel to the first rotation axis line, and a second shaft-side guiding section that engages with the first movable side guiding section.

6. The hinge device base according to claim 1, wherein the fitting recessed section is provided as a pair at both sides of the shaft guiding recessed section in the first direction, the fitting section is provided as a pair at both sides of the first movable member in the first direction, and each fitting section is inserted into the corresponding fitting recessed section so as to be capable of sliding in the first direction.

7. The hinge device base according to claim 2, wherein the first movable member runs along the first face and extends in the second direction orthogonal to the first direction, and a locking protrusion is formed at one end of the first movable member in the second direction, and the locking protrusion catches on an edge of the substrate in the second direction so as to be capable of sliding in the first direction; and a connection projection is further provided at the substrate, and the other end of the first movable member in the second direction is connected by a connection pin, extending in the first direction, to the connection projection so as to be capable of moving in the first direction.

8. The hinge device base according to claim 6, wherein the first movable member runs along the first face and extends in the second direction orthogonal to the first direction, and a locking protrusion is formed at one end of the first movable member in the second direction, and the locking protrusion catches on an edge of the substrate in the second direction so as to be capable of sliding in the first direction; and a connection projection is further provided at the substrate, and the other end of the first movable member in the second direction is connected by a connection pin, extending in the first direction, to the connection projection so as to be capable of moving in the first direction.

9. The hinge device base according to claim 1, wherein the first movable member runs along the first face and extends in the second direction orthogonal to the first direction, and a locking protrusion is formed at one end of the first movable member in the second direction, and the locking protrusion catches on an edge of the substrate in the second direction so as to be capable of sliding in the first direction; and a connection projection is further provided at the substrate, and the other end of the first movable member in the second direction is connected by a connection pin, extending in the first direction, to the connection projection so as to be capable of moving in the first direction.

* * * * *